US006045987A

United States Patent [19]

Shimada et al.

[11] Patent Number: 6,045,987

[45] Date of Patent: Apr. 4, 2000

[54] SILVER HALIDE COLOR PHOTOGRAPHIC LIGHT-SENSITIVE MATERIAL

[75] Inventors: Yasuhiro Shimada; Hiroyuki Yoneyama, both of Minami-ashigara, Japan

[73] Assignee: Fuji Photo Film Co., Ltd., Kanagawa-ken, Japan

[21] Appl. No.: 08/827,420

[22] Filed: Mar. 27, 1997

[30] Foreign Application Priority Data

Apr. 5, 1996 [JP] Japan ..... 8-108696

[51] Int. Cl.[7] ..... G03C 1/295

[52] U.S. Cl. ..... 430/546; 430/631

[58] Field of Search ..... 430/546, 631

[56] References Cited

U.S. PATENT DOCUMENTS

| | | | |
|---|---|---|---|
| 4,540,657 | 9/1985 | Krishnamurthy | 430/546 |
| 5,200,303 | 4/1993 | Takahashi et al. | 430/546 |

FOREIGN PATENT DOCUMENTS

| | | |
|---|---|---|
| 0309160 | 3/1989 | European Pat. Off. . |
| 0529727A1 | 3/1993 | European Pat. Off. . |
| 0546500A1 | 6/1993 | European Pat. Off. . |
| 0570974A1 | 11/1993 | European Pat. Off. . |
| 0583832A1 | 2/1994 | European Pat. Off. . |
| 0606659A1 | 7/1994 | European Pat. Off. . |
| 6258800 | 9/1994 | Japan . |
| 6258801 | 9/1994 | Japan . |
| 6268802 | 9/1994 | Japan . |

*Primary Examiner*—Hoa Van Le

*Attorney, Agent, or Firm*—Birch, Stewart, Kolasch & Birch, LLP

[57] ABSTRACT

There is disclosed a silver halide color photographic light-sensitive material which comprises a compound of the formula (I) contained in at least one hydrophilic colloid layer on a support:

formula (I)

wherein $R^1$ and $R^2$ each represent an aliphatic group, an aromatic group, or a heterocyclic group; $R^3$ represents a substituent; m and n are each an integral number of 0 to 5, provided that $m+n \leqq 5$; and $R^1$ and $R^2$ may bond together to form a ring. The light-sensitive material is excellent in the solubility and dispersion stability of photographic reagents, good in color reproduction, and excellent in the fastness of dye images.

20 Claims, No Drawings

SILVER HALIDE COLOR PHOTOGRAPHIC LIGHT-SENSITIVE MATERIAL

FIELD OF THE INVENTION

The present invention relates to a silver halide light-sensitive material, and more particularly to a silver halide color light-sensitive material that has a nondiffusion coupler capable of forming a nondiffusion dye built in a silver halide emulsion, and that can form a color image.

BACKGROUND OF THE INVENTION

Conventionally, a photographically useful reagent that is hardly soluble in water {e.g. an oil-soluble coupler; an antioxidant used in preventing fading, color fog, or color mixing (e.g. alkylhydroquinones, alkylphenols, chromans, and cumarones); a hardener, an oil-soluble filter dye, an oil-soluble ultraviolet absorber, an oil-soluble fluorescent whitening agent, a DIR compound (e.g. DIR hydroquinones and non-dye-forming DIR couplers), a developer, a dye developer, a DRR compound, and a DDR coupler} is used in the following manner. That is, the reagent is dissolved in a suitable oil agent, i.e. a high-boiling solvent; and the solution is dispersed in a hydrophilic organic colloid, especially an aqueous solution of gelatin, in the presence of a surface-active agent, to form a hydrophilic organic colloid layer (e.g. a light-sensitive emulsion layer, a filter layer, a backing layer, an antihalation layer, an intermediate layer, and a protective layer) having the reagent contained therein in a dispersed state. As the high-boiling organic solvent, a phthalate compound or a phosphate compound is generally used.

A phthalate compound and a phosphate compound that are high-boiling organic solvents are used in many cases because they are excellent, for example, in view of affinity to colloids, such as gelatin; dispersibility of couplers; influence on the stability of color-formed images; influence on the hue of color-formed images; chemical stability in light-sensitive materials; and inexpensive availability. However, these known high-boiling organic solvents (e.g. phthalate compounds and phosphate compounds) are unsatisfactory in view of, especially, the effect of preventing the occurrence of stain and fading of color images due to light, heat, and humidity, in the case of recent light-sensitive materials in which high performance is demanded. Thus, various requirements are placed on high-boiling organic solvents used in recent light-sensitive materials. General requirements are that, for example, they can be obtained or produced inexpensively; they are excellent in capability of dissolving photographically useful reagents or of dispersing photographically useful reagents stably; they do not have adverse effects on developability and photographic characteristics; they are excellent in chemical stability, and they are excellent in the effect of preventing fading of color images.

On the other hand, in color light-sensitive materials, the molecules of the dyes formed from pyrazoloazole magenta couplers or pyrroloazole cyan couplers that are excellent in hue, associate with each other readily in the film. The maximum absorption wavelength of the absorption by the association product is different from that of the single dye molecule itself. The larger the absorption by the association product is, the more unpreferable it is in view of the color reproduction. If the maximum absorption wavelength of a dye can be suitably made, without changing the structure of the dye itself, longer or shorter by adding an additive or the like to the same layer in which the dye is present, a color light-sensitive material whose color reproduction is more preferable can be provided inexpensively.

In connection with the above matter, it is found that among high-boiling organic solvents capable of becoming dispersion media for dye-forming nondiffusion couplers or the like, some high-boiling organic solvents have an effect of making shorter or longer the maximum absorption wavelength of yellow, magenta, or cyan dyes, or an effect of changing the absorption waveform by suppressing or promoting the association of the molecules of dyes. For example, urea compounds described in European Patent No. 0309160 A1, and amide compounds described in European Patent No. 0309160 A1, can be mentioned. However, in many cases these compounds are difficult to, simultaneously, make the hue of the dye preferable and make favorable the solubility and the dispersion stability of the required material, when the compounds are used as a dispersion medium. Also in many cases, the fading of the dyes formed by couplers, due to heat, humidity, or light is deteriorated. Compounds that can solve these problems are proposed and described in JP-A ("JP-A" means unexamined published Japanese patent application) Nos. 258800/1994, 258801/1994, and 258802/1994. However, the light-fading of the dyes formed by couplers obtained by using these compounds is not necessarily satisfactory, and further improvement is required.

SUMMARY OF THE INVENTION

An object of the present invention is to provide a silver halide color photographic light-sensitive material that is excellent in the solubility and dispersion stability of photographic reagents, good at color reproduction of images, and excellent in the fastness of dye images.

Other and further objects, features, and advantages of the invention will appear more fully from the following description.

DETAILED DESCRIPTION OF THE INVENTION

The above object has been attained by the following silver halide color photographic light-sensitive material.

That is, the present invention provides:

(1) A silver halide color photographic light-sensitive material, comprising a non-color-forming compound represented by the following formula (I) contained in at least one hydrophilic colloid layer on a support:

formula (I)

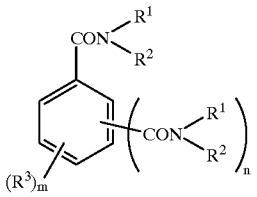

wherein $R^1$ and $R^2$ each represent an aliphatic group, an aromatic group, or a heterocyclic group; $R^3$ represents a substituent; m and n are each an integral number of 0 to 5, provided that $m+n \leqq 5$; and $R^1$ and $R^2$ may bond together to form a ring, and (2) The silver halide color photographic light-sensitive material stated in the above (1), wherein the said layer containing at least one compound represented by formula (I) contains at least one cyan coupler represented by the following formula (II), or at least one magenta coupler represented by the-following formula (III):

formula (II)

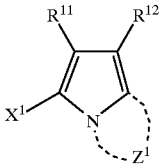

formula (III)

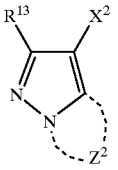

wherein $Z^1$ and $Z^2$ each represent a group of nonmetal atoms required to form an azole ring whose hetero atom is a nitrogen atom, $R^{11}$ and $R^{12}$ each represent an electron-attractive group whose Hammett substituent constant $\sigma_p$ value is 0.30 or more, $R^{13}$ represents a hydrogen atom or a substituent, and $X^1$ and $X^2$ each represent a hydrogen atom or a group capable of being released upon the coupling reaction with the oxidation product of a color-developing agent.

Now, the compounds for use in the present invention are described in detail.

$R^1$ and $R^2$ each represent an aliphatic group, an aromatic group, or a heterocyclic group. When $R^1$ and $R^2$ are aliphatic groups, they may be straight-chain, branched-chain, or cyclic; they may be saturated or unsaturated, and they may be substituted or unsubstituted. Examples are a straight-chain or branched-chain alkyl group, aralkyl group, alkenyl group, alkynyl group, cycloalkyl group, or cycloalkenyl group having 1 to 36 carbon atoms, and more specific examples are methyl, ethyl, allyl, propyl, isopropyl, t-butyl, t-amyl, isoamyl, hexyl, t-octyl, 2-ethylhexyl, isononyl, dodecyl, tridecyl, chloromethyl, trifluoromethyl, methoxyethyl, cyclopentyl, and cyclohexyl. Preferably, $R^1$ and $R^2$ are each an unsubstituted aliphatic group more preferably having 1 to 18 carbon atoms, and particularly preferably 3 to 10 carbon atoms. More preferably $R^1$ and $R^2$ are the same, and most preferably they are each a cyclic alkyl group having 3 to 8 carbon atoms.

When $R^1$ and $R^2$ each represent an aromatic group, the aromatic portion may be substituted or unsubstituted, and it may be a monocycle or a condensed ring, preferably having 6 to 36 carbon atoms, with preference given to a monocycle. Specific examples include phenyl, 4-t-butylphenyl, 2-methylphenyl, 2,4,6-trimethylphenyl, 2-methoxyphenyl, 4-methoxyphenyl, 2,6-dichlorophenyl, 2-chlorophenyl, and 2,4-dichlorophenyl.

When $R^1$ and $R^2$ each represent a heterocyclic group, preferably the heterocyclic group is a saturated or unsaturated 5- to 8-membered ring having 1 to 36 carbon atoms and containing a nitrogen atom, an oxygen atom, or a sulfur atom. More preferably the heterocyclic group is a 5- or 6-membered ring containing a nitrogen atom, with particular preference given to a 6-membered ring.

Specific examples include imidazole, pyrazole, triazole, lactam compounds, piperidine, pyridine, pyrrolidine, pyrrole, morpholine, pyrazolidine, thiazolidine, and pyrazoline.

$R^1$ and $R^2$ may bond together to form a ring, and examples of the ring include the same rings as the nitrogen-containing heterocycles out of the rings described above for heterocycles.

In formula (I), $R^3$ represents a substituent. Examples of the substituent include an aryl group (preferably having 6 to 36 carbon atoms), an alkyl group (preferably having 1 to 36 carbon atoms), a hydroxyl group, a halogen atom (e.g. fluorine, chlorine, and bromine), a carbamoyl group (e.g. ethylcarbamoyl and dimethylcarbamoyl), an alkoxycarbonyl group (e.g. ethoxycarbonyl and isopropoxycarbonyl), an acylamino group (e.g. acetylamino), a sulfonamido group (e.g. methanesulfonamido and p-toluenesulfonamido), a ureido group (e.g. methylureido and dimethylureido), an alkylamino group (e.g. methylamino and diethylamino), an alkoxy group (e.g. methoxy and ethoxy), an aryloxy group (e.g. phenoxy and o-methoxyphenyl), an alkylthio group (e.g. methylthio and ethylthio), an arylthio group (e.g. phenylthio), a nitro group, a cyano group, a sulfamoyl group (e.g. methylsulfamoyl), a sulfonyl group (e.g. methanesulfonyl), a carboxyl group, and a phosphono group. These groups may have a substituent that is the same as mentioned for $R^3$, if possible.

m and n are each an integral number of 0 to 5, and preferably m is an integral number of 0 to 2, and n is an integral number of 1 to 3.

Specific examples of the compound represented by formula (I) for use in the present invention are shown below, but the present invention is not limited to them.

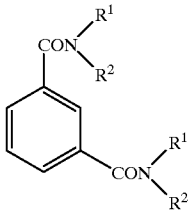
| NO | $R^1$ | $R^2$ |
|---|---|---|
| 1 | C2H5 | C2H5 |
| 2 | CH2CH═CH2 | CH2CH═CH2 |
| 3 | C4H9(n) | C4H9(n) |
| 4 | C6H13(n) | C6H13(n) |
| 5 | 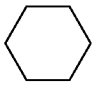 | 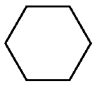 |
| 6 | C8H17(n) | C8H17(n) |
| 7 | CH2CH($C_2H_5$)($C_4H_9$) | CH2CH($C_2H_5$)($C_4H_9$) |
| 8 | 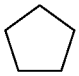 | 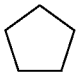 |
| 9 | 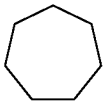 | 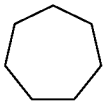 |
| 10 | CH2CH2OCH3 | CH2CH2OCH3 |
| 11 | 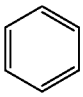 | 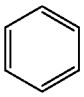 |
| 12 | 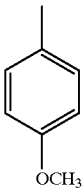 | 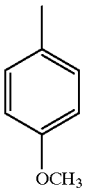 |
| 13 | 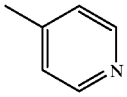 | 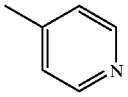 |
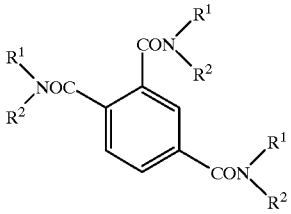
| NO | $R^1$ | $R^2$ |
|---|---|---|
| 14 | CH2CH(CH3)2 | CH2CH(CH3)2 |
| 15 | C4H9(n) | C4H9(n) |
| 16 | C5H11 | C5H11 |
| 17 | C6H13(n) | C6H13(n) |
| 18 | 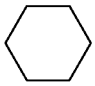 | 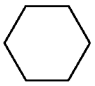 |
| 19 | C8H17(n) | C8H17(n) |
| 20 | CH2CH($C_2H_5$)($C_4H_9$) | CH2CH($C_2H_5$)($C_4H_9$) |
| 21 | 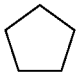 | 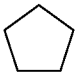 |
| 22 | 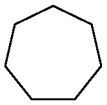 | 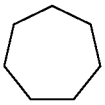 |
| 23 | 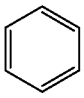 | 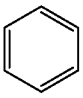 |
(24)
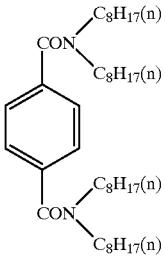
(25)
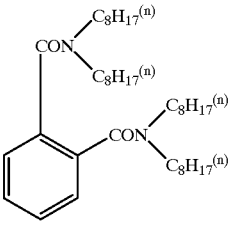

(26)
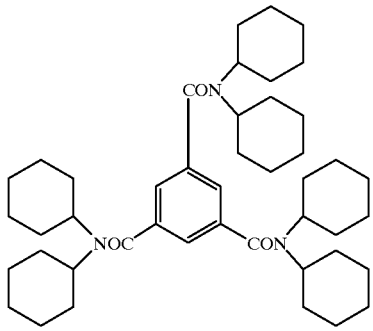
(27)
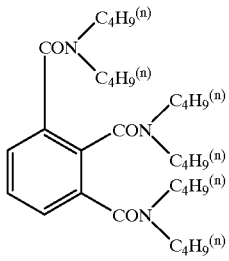
(28)
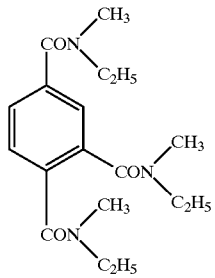
(29)
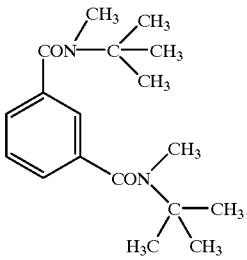
(30)
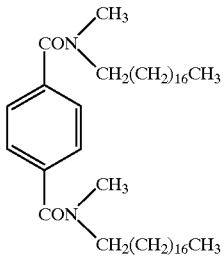
(31)
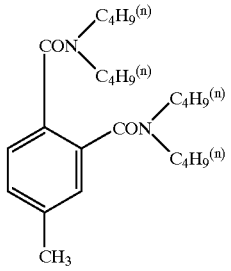
(32)
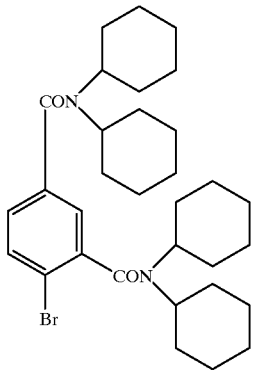
(33)
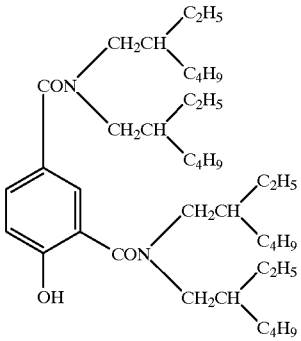
(34)
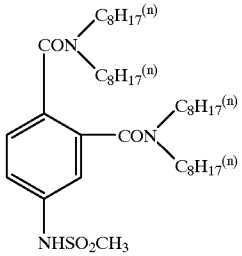

(35)
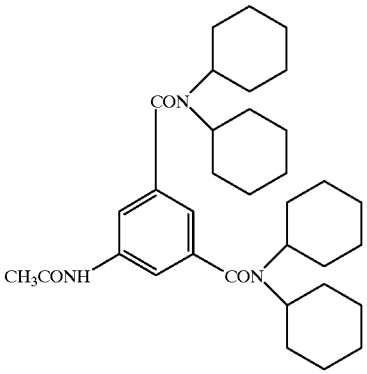
(36)
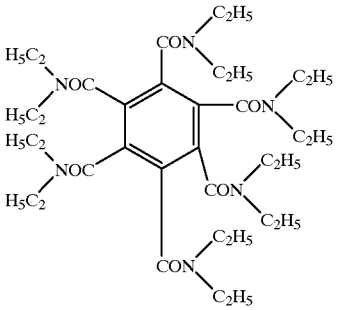
(37)
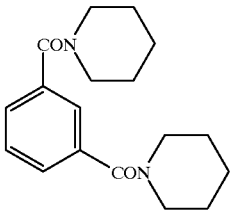
(38)
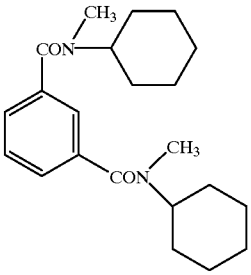
(39)
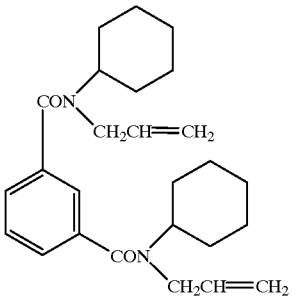
(40)
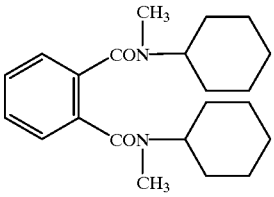
(41)
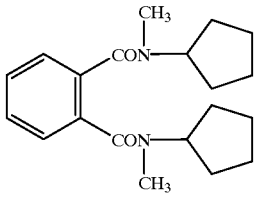
(42)
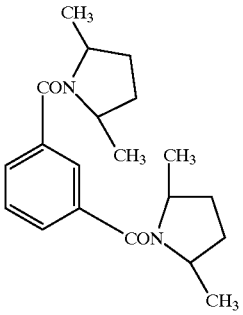
(43)
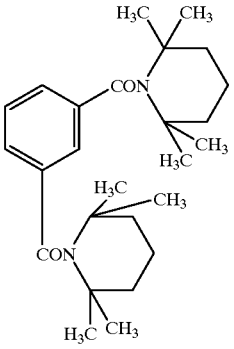
(44)
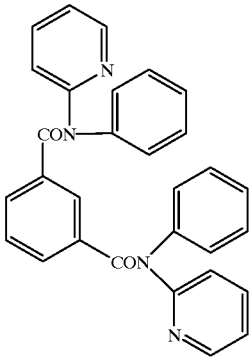

(45)

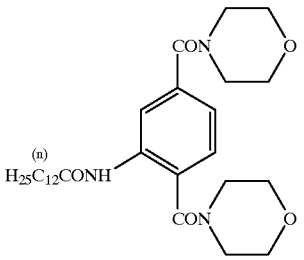

The compound represented by formula (I) can be synthesized according to methods described in JACS, Vol. 75, page 2686 (1953), and Chem. Rev., Vol. 52, page 237 (1953).

Specific examples for synthesizing the compounds for use in the present invention are now described below.

Synthetic Example 1 Synthesis of Exemplified Compound (5)

Exemplified Compound (5) was synthesized through the following route:

100 g of isophthaloyl chloride was dissolved in 1,000 ml of acetonitrile, and 362 g of dicyclohexylamine was added thereto, dropwise, slowly at room temperature. After the reaction, 500 ml of ethyl acetate was added, followed by stirring well, and then the salt was filtered off. After the filtrate was concentrated, 500 ml of acetonitrile was added, followed by cooling. The deposited crystals were filtered, to obtain 165 g of the intended Exemplified Compound. The melting point was 157 to 158° C.

Other compounds can be synthesized similarly.

The compound represented by formula (I) for use in the present invention is contained in at least one layer on a support of a photographic material, which layer is desirably a hydrophilic colloid layer, and preferably the compound represented by formula (I) can be contained in a silver halide emulsion layer that contains at least one dye-forming non-diffusion coupler.

The compound represented by formula (I) for use in the present invention is a non-color-forming compound that does not cause a coupling reaction with the oxidization product of a developing agent or a color-forming reducing agent, thereby no dye is formed. Therefore, the compound of the formula (I) has no coupler residue in its molecular structure.

The amount of the compound represented by formula (I) to be used can be varied in accordance with the purpose and is not particularly restricted. The usage amount is preferably 0.0002 to 20 g, and more preferably 0.001 to 5 g, per $m^2$ of the light-sensitive material, and generally the weight ratio to the photographically useful reagent, such as a coupler, is generally in the range of from 0.1 to 4, and preferably from 0.1 to 2.

In the present invention, the compound represented by formula (I) is preferably used to disperse/dissolve the reagent for photography, and, in that case, generally a dispersion medium is used.

The amount of the dispersion comprising the compound represented by formula (I) for use in the present invention and the photographically useful reagent, such as a coupler, to be used for the dispersion medium, is such that the weight ratio of the dispersion to the dispersion medium is generally in the range of from (2:1) to (0.1:1), and preferably from (1.0:1) to (0.2:1). Herein the dispersion medium is, for example, typically gelatin, and it may also be a hydrophilic polymer, such as a polyvinyl alcohol. The dispersion in the present invention can contain, in addition to the compound for use in the present invention and the photographically useful reagents, various compounds in accordance with the purpose.

The compound represented by formula (I) for use in the present invention can be used in combination with a conventionally known high-boiling organic solvent. If these known high-boiling organic solvents are additionally used, the compound used in the present invention is used preferably in an amount of 10% or more, and more preferably 30% or more, by weight based on the total amount of the high-boiling organic solvents in the same layer.

Examples of the high-boiling organic solvent that can be used in combination with the compound represented by formula (I) for use in the present invention are described, for example, in U.S. Pat. No. 2,322,027. Specific examples of high-boiling organic solvents having a boiling point of 175° C. or higher at normal pressures are phthalates (e.g. dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, and bis(1,1-diethylpropyl) phthalate), phosphates and phosphonates (e.g. triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, and di-2-ethylhexylphenyl phosphate), benzoates (e.g. 2-ethylhexyl benzoate, dodecyl benzoate, and 2-ethylhexyl-p-hydroxy benzoate), amides (e.g. N,N-diethyldodecaneamide, N,N-diethyllaurylamide, and N-tetradecylpyrrolidone), sulfonamides (e.g. N-butylbenzenesulfoneamide), alcohols or phenols (e.g. isostearyl alcohol and 2,4-di-t-amylphenol), aliphatic carboxylates (e.g. bis(2-ethylhexyl) sebacate, dioctyl azelate, glycerol tributylate, isostearyl lactate, and trioctyl citrate), aniline derivatives (e.g. N,N-dibutyl-2-butoxy-5-t-octylaniline), hydrocarbons (e.g. paraffins, dodecylbenzene, and diisopropylnaphthalene), and chlorinated paraffins. As co-solvents, for example, organic solvents having a boiling point of 30° C. or higher, and preferably 50° C. or higher but 160° C. or lower, can be used, and typical examples are ethyl acetate, butyl acetate, ethyl propionate, methyl ethyl ketone, cyclohexanone, 2-ethoxyethyl acetate, and dimethylformamide.

As the photographically useful reagent that can be used in the present invention, in addition to the dye-forming non-diffusion couplers (yellow couplers, cyan couplers, and magenta couplers), antioxidants used for preventing fading, color fog, or color mixing (e.g. alkylhydroquiones, alkylphenols, chromans, and cumarones), hardeners, oil-soluble filter dyes, oil-soluble ultraviolet absorbers, oil-soluble fluorescent whitening agents, DIR compounds (e.g. DIR hydroquinones and non-dye-forming DIR couplers), developers, dye developers, DDR redox compounds, and DDR couplers can be mentioned.

Examples of yellow couplers are described, for example, in U.S. Pat. Nos. 3,933,501, 4,022,620, 4,326,024, 4,401,752, and 4,248,961, JP-B ("JP-B" means examined Japanese patent publication) No. 10739/1983, British Patent Nos.

1,425,020 and 1,476,760, U.S. Pat. Nos. 3,973,968, 4,314,023, and 4,511,649, European Patent Nos. 249473 A, 446863 A, and 447969, and JP-A Nos. 23145/1988, 123047/1988, 250944/1989, 213648/1989, 139544/1990, 179042/1991, and 203545/1991.

As the magenta couplers, 5-pyrazolone compounds and pyrazoloazole compounds can be mentioned, which are described, for example, in U.S. Pat. Nos. 4,310,619 and 4,351,897, European Patent No. 73636, U.S. Pat. Nos. 3,061,432 and 3,725,067, Research Disclosure No. 24220 (June, 1984), JP-A No. 33552/1985, Research Disclosure No. 24230 (June, 1984), JP-A Nos. 43659/1985, 72238/1986, 35730/1985, 118034/1980, and 185951/1985, U.S. Pat. Nos. 4,500,630, 4,540,654, and 4,556,630, and International Publication No. WO 088/04795.

As the cyan couplers, phenol couplers and naphthol couplers can be mentioned, and those described, for example, in U.S. Pat. Nos. 4.052,212, 4,146,396, 4,228,233, 4,296,200, 2,369,929, 2,801,171, 2,772,162, 2,895,826, 3,772,002, 3,758,308, 4,334,011, and 4,327,173, West German Patent Publication No. 3329729, European Patent Nos. 121365 A and 249453 A, U.S. Pat. Nos. 3,446,622, 4,333,999, 4,775,616, 4,451,559, 4,427,767, 4,690,889, 4,254,212, and 4,296,199 and JP-A No. 42658/1986 are preferable. Azole couplers described in JP-A Nos. 553/1989, 554/1989, 555/1989, and 556/1989, and Japanese patent application Nos. 280964/1991 and 335916/1991; imidazole couplers described in U.S. Pat. No. 4,818,672 and JP-A No. 33144/1990; imidazole couplers described in JP-A No. 32260/1989; pyrroloazole couplers described, for example, in U.S. Pat. Nos. 5,256,526 and 5,384,236; or cyclic active-methylene type cyan couplers described in JP-A No. 32260/1989, can also be used.

In the present invention, more preferably the compound represented by formula (I) is used in the same layer in which, out of couplers, particularly a cyan coupler represented by the following formula (II), or a magenta coupler represented by the following formula (III), is present, because the position of the maximum absorption wavelength of the dye and the magnitude of the association peak are greatly influenced.

formula (II)

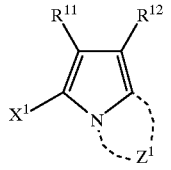

formula (III)

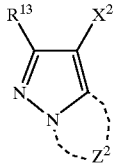

wherein $Z^1$ and $Z^2$ each represent a group of nonmetal atoms required to form an azole ring whose hetero atom is a nitrogen atom, $R^{11}$ and $R^{12}$ each represent an electron-attractive group whose Hammett substituent constant $\sigma_p$ value is 0.30 or more, $R^{13}$ represents a hydrogen atom or a substituent, and $X^1$ and $X^2$ each represent a hydrogen atom or a group capable of being released upon the coupling reaction with the oxidization product of a color-developing agent or a color-forming reducing agent.

Examples of the azole ring formed by $Z^1$ and $Z^2$ include (Z-1)

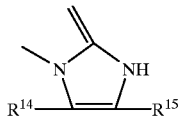

(Z-2)

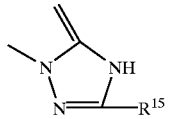

(Z-3)

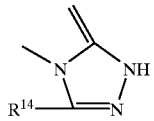

(Z-4)

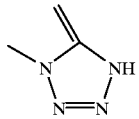

(Z-5)

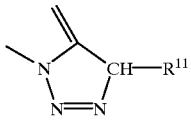

(Z-6)

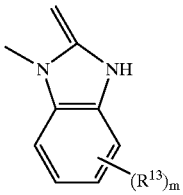

(Z-7)

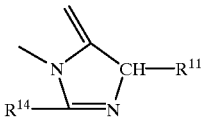

(Z-8)

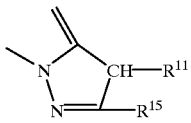

wherein $R^{14}$ and $R^{15}$ each represent a hydrogen atom or a substituent. As $Z^1$ and $Z^2$, the above Z-2 and Z-3 are preferable, with particular preference given to Z-2.

$R^{11}$ and $R^{12}$ each represent an electron-attractive group whose Hammett substituent constant $\sigma_p$ value is 0.30 or more. The preferable upper limit of the Hammett substituent constant $\sigma_p$ value of the electron-attractive group is 1.0 or below. The Hammett rule is an empirical rule suggested by L. P. Hammett in 1935 in order to deal quantitatively with the influence of substituents on reactions or equilibria of benzene derivatives, and nowadays its validity is widely accepted. The substituent constants determined by the Hammett rule include $\sigma_p$ values and $\sigma_m$ values, many of which are described in general books and are described in detail, for example, by J. A. Dean in "Lange's Handbook of Chemistry," 12th edition, 1979 (McGraw-Hill), and in "Kagaku no Ryoiki Zokan," No. 122, pages 96 to 103, 1979 (Nanko-do). In the present invention, $R^{11}$ and $R^{12}$ are stipulated by the Hammett substituent constant $\sigma_p$ values, but the present invention should, of course, not be construed as being limited to the substituents whose values are known and described in literature in these books; rather the present invention includes substituents whose Hammett substituent constant $\sigma_p$ values are not known in the literature but fall within the above range when measured in accordance with the Hammett rule.

With reference to $R^{11}$ and $R^{12}$, more particularly, examples of the electron-attractive group with a $\sigma_p$ value of 0.30 or more include an acyl group (e.g. acetyl, 3-phenylpropanoyl, benzoyl, and 4-dodecyloxybenzoyl), a carbamoyl group (e.g. carbamoyl, N-ethylcarbamoyl, N-phenylcarbamoyl, N,N-dibutylcarbamoyl, N-(2-dodecyloxyethyl)carbamoyl, N-(4-n-pentadecaneamido) phenylcarbamoyl, N-methyl-N-dodecylcarbamoyl, and N-{3-(2,4-di-t-amylphenoxy)propyl}carbamoyl), an alkoxycarbonyl group (e.g. methoxycarbonyl, ethoxycarbonyl, isopropyloxycarbonyl, t-butyloxycarbonyl, isobutyloxycarbonyl, butyloxycarbonyl, dodecyloxycarbonyl, octadecyloxycarbonyl, and 2,6-di-t-butyl-4-methylcyclohexyloxycarbonyl), an aryloxycarbonyl group (e.g. phenoxycarbonyl), a cyano group, a nitro group, a sulfinyl group (e.g. 3-phenoxypropylsulfinyl and 3-pentadecylphenylsulfinyl), a sulfonyl group (e.g. methanesulfonyl, octanesulfonyl, benzenesulfonyl, and toluenesulfonyl), a sulfonyloxy group (e.g. methanesulfonyloxy and toluenesulfonyloxy), a sulfamoyl group (e.g. N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), an alkyl group substituted with at least three fluorine atoms (e.g. trifluoromethane and hepetafluoropropane), and a perfluoroaryl group (e.g. pentafluorophenyl).

Representative electron-attractive groups with a $\sigma_p$ value of 0.30 or more, and their $\sigma_p$ values, are, for example, a cyano group (0.66), a nitro group (0.78), a trifluoromethyl group (0.54), a carboxyl group (0.45), an acetyl group (0.50), a benzoyl group (0.43), a trifluoromethanesulfonyl group (0.92), a methanesulfonyl group (0.72), a benzenesulfonyl group (0.70), a methanesulfinyl group (0.49), a carbamoyl group (0.36), a methoxycarbonyl group (0.45), an ethoxycarbonyl group (0.45), a phenoxycarbonyl group (0.44), a pyrazolyl group (0.37), a methanesulfonyloxy group (0.36), a dimethoxyphospholyl group (0.60), a sulfamoyl group (0.57), and a pentafluorophenyl group (0.41).

In formula (II), preferably, $R^{11}$ and $R^{12}$ each represent a cyano group, an acyl group, a carbamoyl group, an alkoxycarbonyl group, or an aryloxycarbonyl group, and more preferably $R^{11}$ represents a cyano group and $R^{12}$ represents a group —$CO_2$—$R^{17}$, wherein $R^{17}$ represents an alkyl group or an aryl group. Particularly preferably $R^{17}$ is a branched alkyl group or a cyclic alkyl group, and most preferably a cyclic alkyl group.

$R^{13}$, $R^{14}$, and $R^{15}$ each represent a hydrogen atom or a substituent, and examples of the substituent include, for example, an aryl group (preferably having 6 to 30 carbon atoms, e.g. phenyl, m-acetylaminophenyl, and p-methoxyphenyl), an alkyl group (preferably having 1 to 30 carbon atoms, e.g. methyl, trifluoromethyl, ethyl, isopropyl, heptafluoropropyl, t-butyl, n-octyl, and n-dodecyl), a cyano group, a formyl group, an acyl group (preferably having 1 to 30 carbon atoms, e.g. acetyl, pivaloyl, benzoyl, furoyl, and 2-pyridinecarbonyl), a carbamoyl group (preferably having 1 to 30 carbon atoms, e.g. methylcarbamoyl, ethylcarbamoyl, dimethylcarbamoyl, and n-octylcarbamoyl), an alkoxycarbonyl group (preferably having 1 to 30 carbon atoms, e.g. methoxycarbonyl, ethoxycarbonyl, isopropoxycarbonyl, and diphenylmethylcarbonyl), an aryloxycarbonyl group (preferably having 7 to 30 carbon atoms, e.g. phenoxycarbonyl, p-methoxyphenoxycarbonyl, m-chlorophenoxycarbonyl, and o-methoxyphenoxycarbonyl), a formylamino group, an acylamino group [such as an alkylcarbonylamino group preferably having 1 to 30 carbon atoms, (e.g. acetylamino, propionylamino, and cyanoacetylamino), an arylcarbonylamino group preferably having 7 to 30 carbon atoms (e.g. benzoylamino, p-toluoylamino, pentafluorobenzoylamino, and m-methoxybenzoylamino), and a heterylcarbonylamino group preferably having 4 to 30 carbon atoms (e.g. 2-pyridylcarbonylamino, 3-pyridylcarbonylamino, and furoylamino)], an alkoxycarbonylamino group (preferably having 2 to 30 carbon atoms, e.g. methoxycarbonylamino, ethoxycarbonylamino, and methoxyethoxycarbonylamino), an aryloxycarbonylamino group (preferably having 7 to 30 carbon atoms, e.g. phenoxycarbonylamino, p-methoxyphenoxycarbonylamino, p-methylphenoxycarbonylamino, and m-chlorophenoxycarbonylamino), a sulfonamido group (preferably having 1 to 30 carbon atoms, e.g. methanesulfonamido, benzenesulfonamido, and p-toluenesulfonamido), a ureido group (preferably having 1 to 30 carbon atoms, e.g. methylureido, dimethylureido, and p-cyanophenylureido), a sulfamoylamino group (preferably having 1 to 30 carbon atoms, e.g. methylaminosulfonylamino, ethylaminosulfonylamino, and anilinosulfonylamino), an unsubstituted amino group, an alkylamino group (preferably having 1 to 30 carbon atoms, e.g. methylamino, dimethylamino, ethylamino, diethylamino, and n-butylamino), an arylamino group (preferably having 6 to 30 carbon atoms, e.g. anilino), an alkoxy group (preferably having 1 to 30 carbon atoms, e.g. methoxy, ethoxy, isopropoxy, n-butoxy, methoxyethoxy, and n-dodecyloxy), an aryloxy group (preferably having 6 to 30 carbon atoms, e.g. phenoxy, m-chlorophenoxy, p-methoxyphenoxy, and o-methoxyphenoxy), a heteryloxy group (preferably having 3 to 30 carbon atoms, e.g. tetrahydropyranyloxy, 3-pyrrolidyloxy, and 2-(1,3-benzimidazolyl)oxy), an alkylthio group (preferably having 1 to 30 carbon atoms, e.g. methylthio, ethylthio, n-butylthio, and t-butylthio), an arylthio group (preferably having 6 to 30 carbon atoms, e.g. phenylthio), a heterylthio group (preferably having 3 to 30 carbon atoms, e.g. 2-pyridylthio, 2-(1,3-benzoimidazolyl)thio, 1-hexadecyl- 1,2,3,4-tetrazolyl-5-thio, and 1-(3-N-octadecylcarbamoyl)phenyl-1,2,3,4-tetrazolyl-5-thio), a heterocyclic group (preferably having 3 to 30 carbon atoms, e.g. 2-benzooxazolyl, 2-benzothiazolyl, 1-phenyl-2-benzimidazolyl, 5-chloro-1-tetrazolyl, 1-pyrrolyl, 2-furanyl, 2-pyridyl, and 3-pyridyl), a halogen atom (e.g. fluorine, chlorine, and bromine), a hydroxyl group, a nitro group, a sulfamoyl group (preferably having 0 to 30 carbon atoms, e.g. methylsulfamoyl, dimethylsulfamoyl, ethylsulfamoyl, and N,N-dipropylsulfamoyl), a sulfonyl group (preferably having 1 to 30 carbon atoms, e.g. methanesulfonyl, benzenesulfonyl, toluenesulfonyl, trifluoromethanesulfonyl, and difluoromethanesulfonyl), an acyloxy group (preferably having 1 to 30 carbon atoms, e.g. formyloxy, acetyloxy, and benzoyloxy), a carbamoyloxy group (preferably having 1 to 30 carbon atoms, e.g. methylcarbamoyloxy and diethylcarbamoyloxy), an imido group (preferably having 4 to 30 carbon atoms, e.g. succinimido and phthalimido), a sulfinyl group (preferably having 1 to 30 carbon atoms, e.g. diethylaminosulfinyl), a phosphoryl group (preferably having 0 to 30 carbon atoms, e.g. dimethoxyphosphoryl and diphenylphosphoryl), a carboxyl group, a phosphono group, and an unsubstituted amino group. These groups may have a substituent that is the same as mentioned for $R^{13}$, $R^{14}$, or $R^{15}$, if possible. Preferably $R^{14}$ and $R^{15}$ each represent an alkyl group or an aryl group.

Particularly preferably $R^{13}$ is a branched alkyl group. More preferably $R^{15}$ is an aryl group, and further more preferably an aryl group substituted by an alkoxy group, an acylamino group, a sulfonamido group, an alkyl group, or the like.

$X^1$ and $X^2$ each represent a hydrogen atom or a group capable of being released upon the coupling reaction with the oxidization product of a color-developing agent or a color-forming reducing agent (hereinafter referred to as "a coupling-off group"). Examples of the coupling-off group include a halogen atom (e.g. fluorine, chlorine, and bromine), an alkoxy group (e.g. ethoxy, dodecyloxy, methoxyethylcarbamoylmethoxy, carboxypropyloxy, and methylsulfonylethoxy), an aryloxy group (e.g. 4-chlorophenoxy, 4-methoxyphenoxy, and 4-carboxyphenoxy), an acyloxy group (e.g. acetoxy, tetradecanoyloxy, and benzoyloxy), a heterocyclic acyloxy group (e.g. morpholinocarbonyloxy and thiomorpholinocarbonyloxy), a sulfonyloxy group (e.g. methanesulfonyloxy and toluenesulfonyloxy), an acylamino group (e.g. dichloroacetylamino and heptafluorobutyrylamino), a sulfonamido group (e.g. methanesulfonamido and p-toluenesulfonamido), an alkoxycarbonyloxy group (e.g. ethoxycarbonyloxy and benzylcarbonyloxy), an arylcarbonyloxy group (e.g. benzoyloxy and 2,6-dichlorobenzoyloxy), an aryloxycarbonyloxy group (e.g. phenoxycarbonyloxy), an alkylthio group (e.g. carboxymethylthio), an arylthio group (e.g. 2-butoxy-5-t-octylphenylthio), a heterocyclic thio group (e.g. tetrazolylthio), a carbamoyloxy group (e.g. diallylcarbamoyloxy), a carbamoylamino group (e.g. N-methylcarbamoylamino and N-phenylcarbamoylamino), a heterocyclic oxy group (e.g. pyrimidinooxy and triazinooxy), a 5- or 6-membered nitrogen-containing heterocyclic group (e.g. imidazolyl, pyrazolyl, triazolyl, tetrazolyl, 1,2-dihydro-2-oxo-1-pyridyl), an imido group (e.g. succinimido and hydantoinyl), an aromatic azo group (e.g. phenylazo), a sulfinyl group (e.g. 2-butoxy-5-t-octylphenylsulfinyl), and a sulfonyl group (e.g. 2-butoxy-5-t-octylphenylsulfonyl).

Preferably $X^1$ and $X^2$ each represent a halogen atom, an arylthio group, a heterocyclic acyloxy group, an arylcarbonyloxy group, or a carbamoyloxy group.

The coupler represented by formula (II) or (III) may form a dimer or more higher polymer with $R^{11}$, $R^{12}$, $R^{13}$, $R^{14}$, or $R^{15}$ having the coupler residue of formula (II) or (III) therein, or it may form a homopolymer or copolymer with $R^{11}$, $R^{12}$, $R^{13}$, $R^{14}$, or $R^{15}$ having a polymer chain. A typical example of the homopolymer or copolymer having a polymer chain attached to it is a homopolymer or copolymer of an addition polymer ethylenically unsaturated compound having the coupler residue of formula (II) or (III). In this case, the polymer may contain one or more types of color-forming repeating units having the coupler residue of formula (II) or (III), and it may be a copolymer containing, as a copolymer component, one or more non-color-forming ethylenically unsaturated monomer, such as acrylates, methacrylates, and maleates.

Specific examples of the compound represented by formula (II) or (III) are shown below, but the present invention is not limited to them.

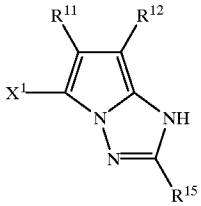
| No. | $R^{11}$ | $R^{12}$ | $R^{15}$ | $X^1$ |
|---|---|---|---|---|
| C-1 | CN | 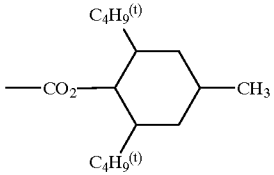 | 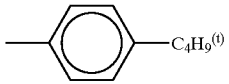 | 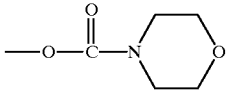 |
| C-2 | CN | 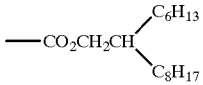 | 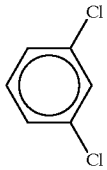 | H |
| C-3 | CN | 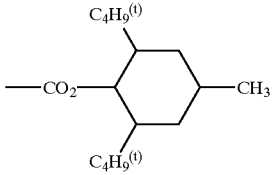 | 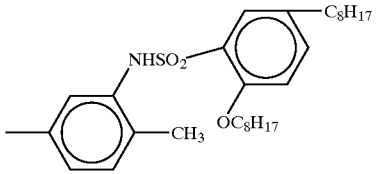 | 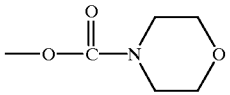 |
| C-4 | CN | 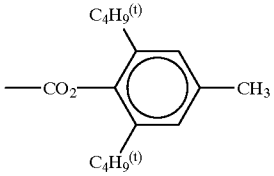 | 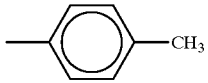 | Cl |

-continued
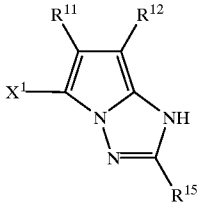
| No. | $R^{11}$ | $R^{12}$ | $R^{15}$ | $X^1$ |
|---|---|---|---|---|
| C-5 | CN | 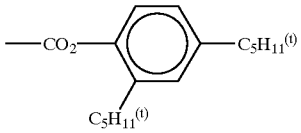 | 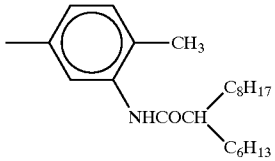 | 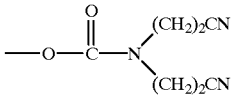 |
| C-6 | CN | 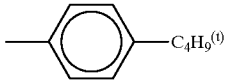 | 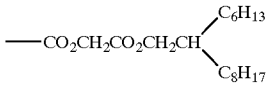 | H |
| C-7 | CN | 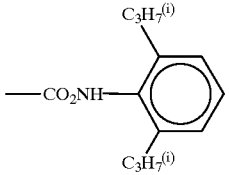 | 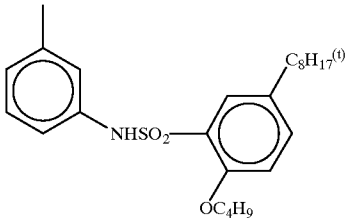 | 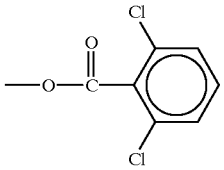 |
| C-8 | CN | 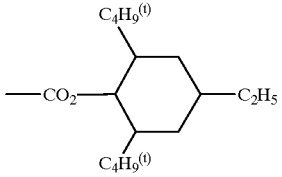 | 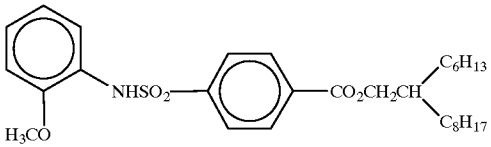 | 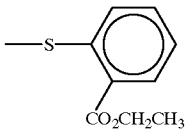 |

-continued
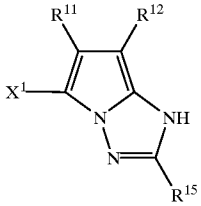
| No. | $R^{11}$ | $R^{12}$ | $R^{15}$ | $X^1$ |
|---|---|---|---|---|
| C-9 | CN | 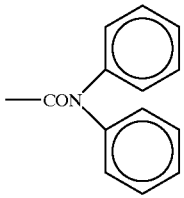 | 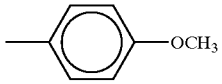 | 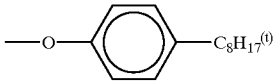 |
| C-10 | CN | 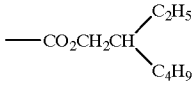 | 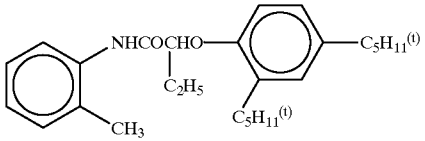 | 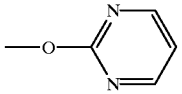 |
| C-11 | $CF_3$ | 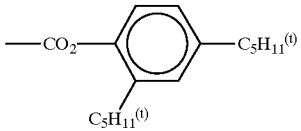 | 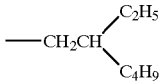 | 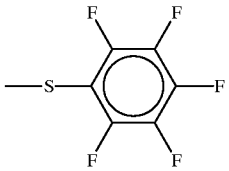 |
| C-12 | CN | 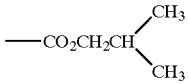 | 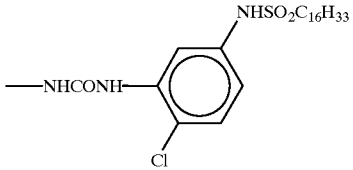 | 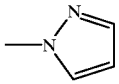 |

-continued
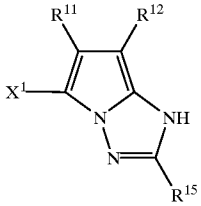
| No. | $R^{11}$ | $R^{12}$ | $R^{15}$ | $X^1$ |
|---|---|---|---|---|
| C-13 | CN | 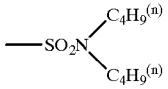 | 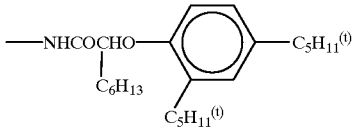 | 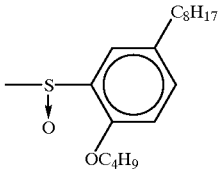 |
| C-14 | CN | 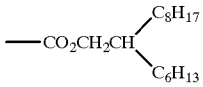 | 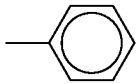 | H |
| C-15 | 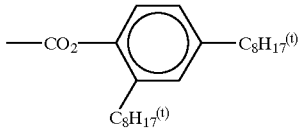 | CN | 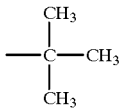 | 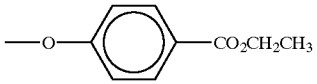 |
| C-16 | $—CO_2CH_2C_8F_{13}$ | CN | 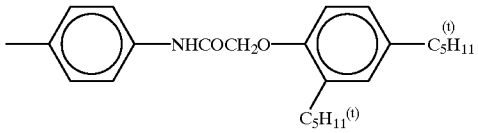 | Cl |

-continued
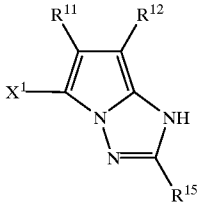
| No. | $R^{11}$ | $R^{12}$ | $R^{15}$ | $X^1$ |
|---|---|---|---|---|
| C-17 | 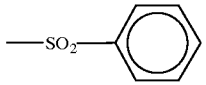 | 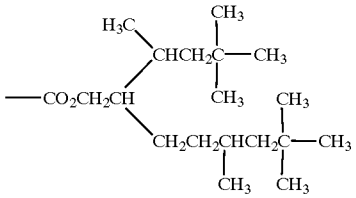 | $—CH_3$ | $—OCOCH_3$ |
| C-18 | CN | 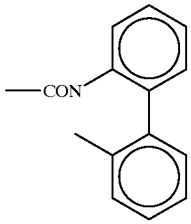 | 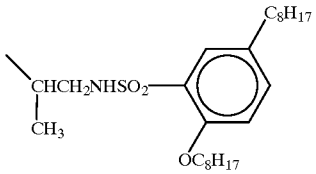 | 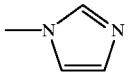 |
| C-19 | CN | 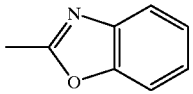 | 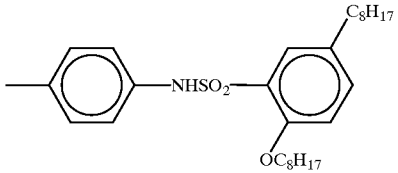 | 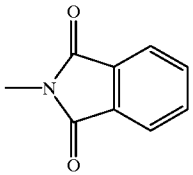 |

-continued
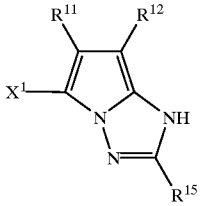
| No. | $R^{11}$ | $R^{12}$ | $R^{15}$ | $X^1$ |
|---|---|---|---|---|
| C-20 | CN | $CF_3$ | 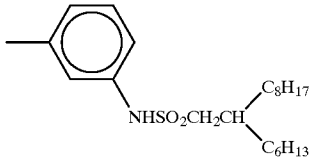 | Cl |
| C-21 | 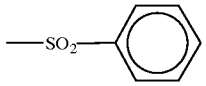 | $CF_3$ | 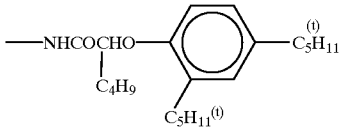 | F |
| C-22 | CN | 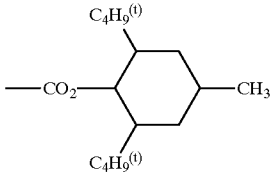 | 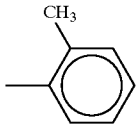 | 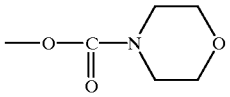 |
| C-23 | CN | 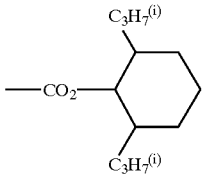 | 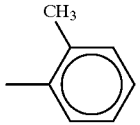 | 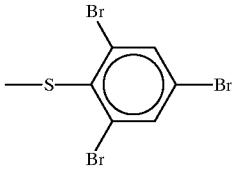 |

-continued
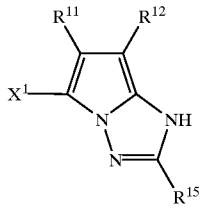
| No. | $R^{11}$ | $R^{12}$ | $R^{15}$ | $X^1$ |
|---|---|---|---|---|
| C-24 | CN | 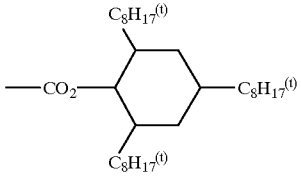 | 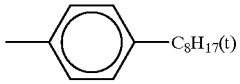 | 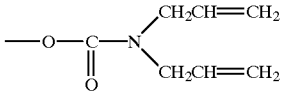 |
| C-25 | CN | 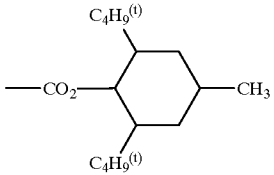 | 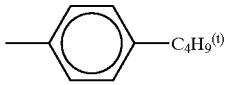 | 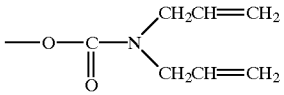 |

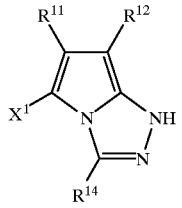
| No. | $R^{11}$ | $R^{12}$ | $R^{14}$ | $X^1$ |
|---|---|---|---|---|
| C-26 | $—CO_2C_2H_5$ | CN | 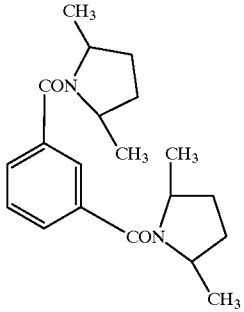 | Cl |
| C-27 | CN | 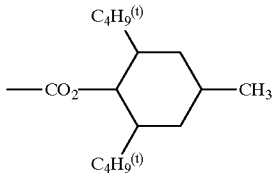 | 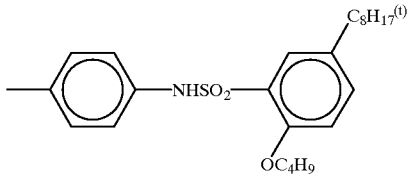 | H |
| C-28 | CN | 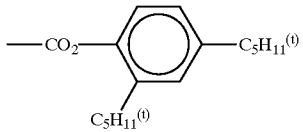 | 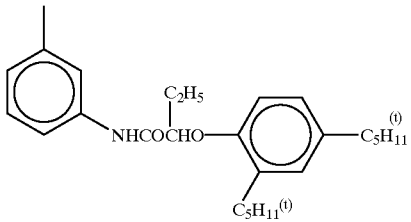 | 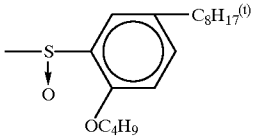 |

-continued
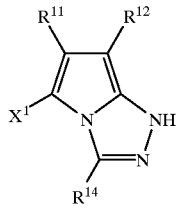
C-29 —$SO_2CH_3$
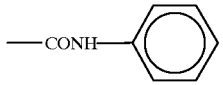
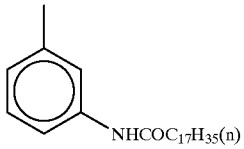
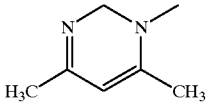
C-30 —$CO_2C_2H_5$ —$CO_2C_2H_5$
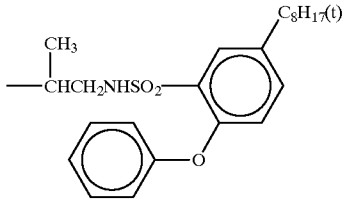
Cl
(C-31)
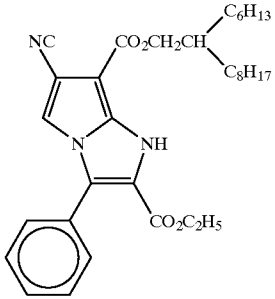

-continued
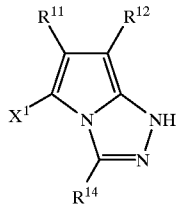
(C-32)
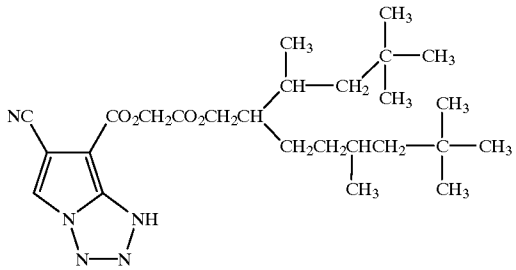
(C-33)
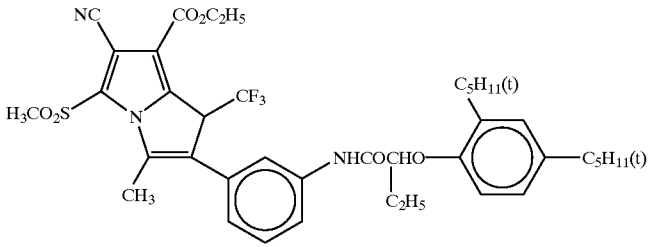
(C-34)
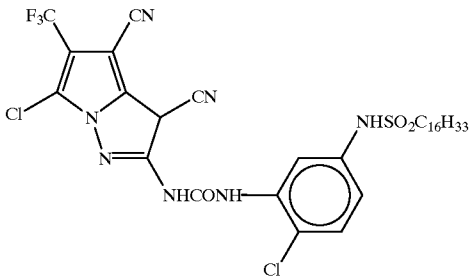

-continued
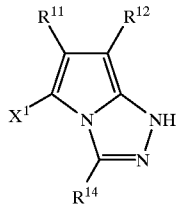
(C-35)
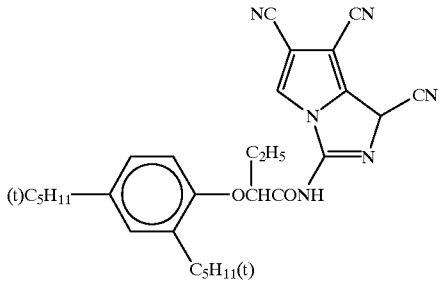
(C-36)
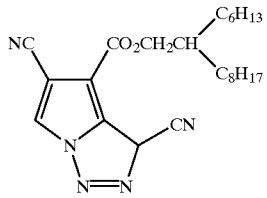

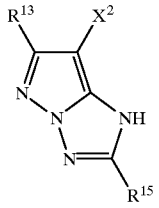
| | $R^{13}$ | $R^{15}$ | $X^2$ |
|---|---|---|---|
| M-1 | $CH_3$— | 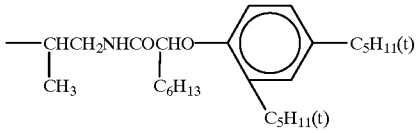 | Cl |
| M-2 | 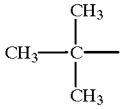 | 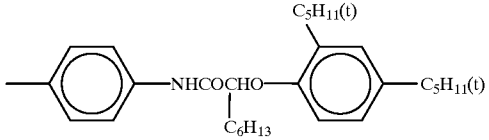 | " |
| M-3 | " | 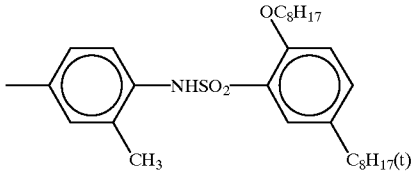 | " |
| M-4 | " | 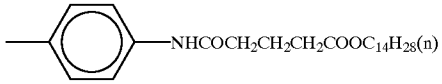 | " |

-continued
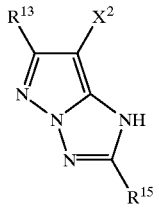
| | $R^{13}$ | $R^{15}$ | $X^2$ |
|---|---|---|---|
| M-5 | " | 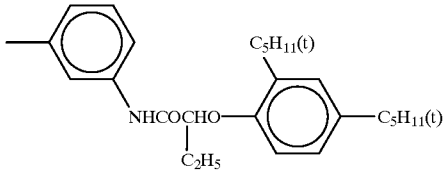 | " |
| M-6 | $CH_3$— | 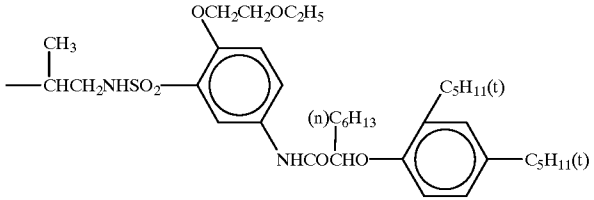 | Cl |
| M-7 | " | 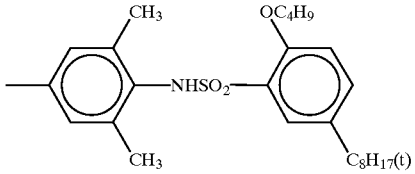 | " |

-continued
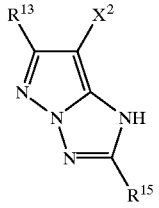
| | $R^{13}$ | $R^{15}$ | $X^2$ |
|---|---|---|---|
| M-8 | " | 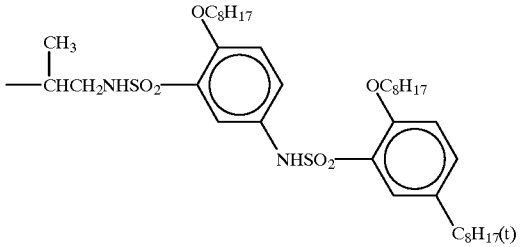 | " |
| M-9 | 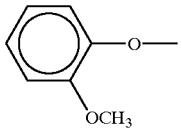 | 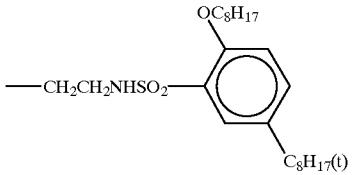 | 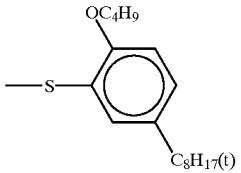 |
| M-10 | $C_2H_5$— | 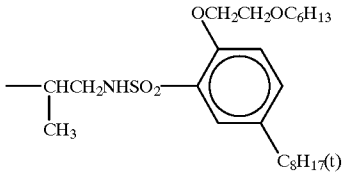 | 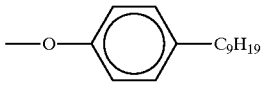 |
| M-11 | 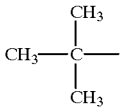 | 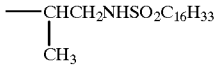 | 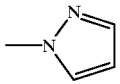 |

-continued
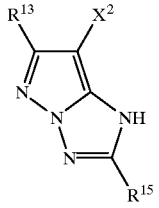
| | $R^{13}$ | $R^{15}$ | $X^2$ |
|---|---|---|---|
| M-12 | 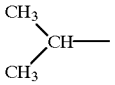 | 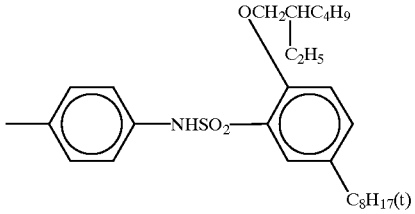 | Cl |
| M-13 | 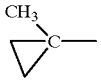 | 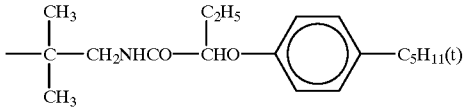 | " |
| M-14 | $C_2H_5O$— | 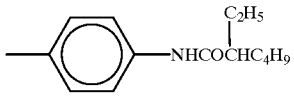 | 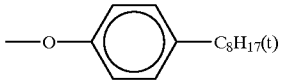 |
| M-15 | $C_2H_5O$— | 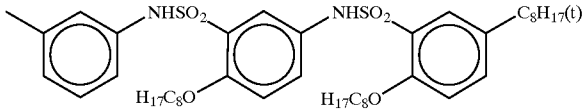 | 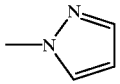 |
| M-16 | 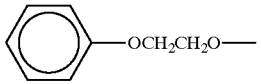 | " | 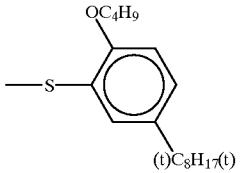 |

-continued
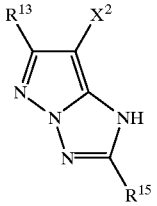
| | $R^{13}$ | $R^{15}$ | $X^2$ |
|---|---|---|---|
| M-17 | $C_2H_5O$— | 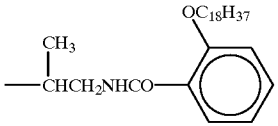 | 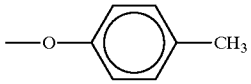 |
| M-18 | $CH_3$— | 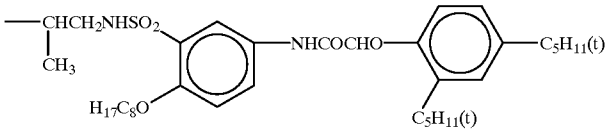 | Cl |

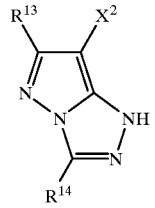
| | $R^{13}$ | $R^{14}$ | $X^2$ |
|---|---|---|---|
| m-1 | 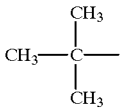 | $-(CH_2)_3-SO_2C_{12}H_{25}$ | Cl |
| m-2 | " | $-CH(CH_3)CH_2CH_3SO_2C_{12}H_{25}$ | " |
| m-3 | " | $-C(CH_3)_2-CH_2SO_2C_{16}H_{33}$ | " |
| m-4 | " | 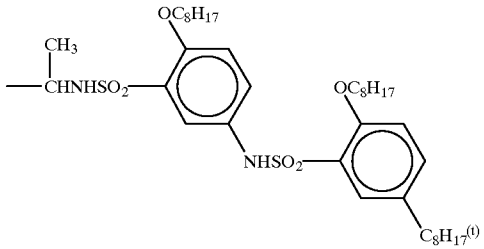 | " |

-continued
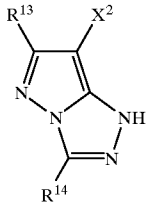
| | $R^{13}$ | $R^{14}$ | $X^2$ |
|---|---|---|---|
| m-5 | " | 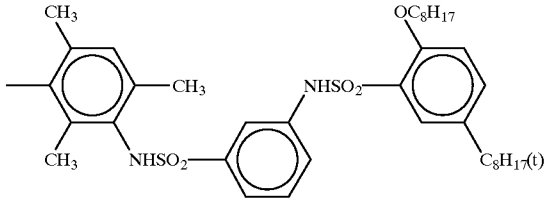 | " |
| m-6 | 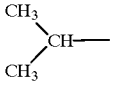 | 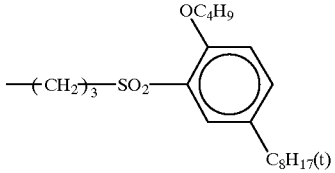 | Cl |
| m-7 | " | 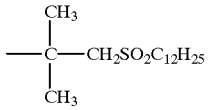 | 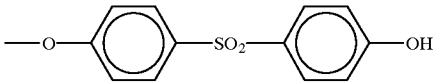 |
| m-8 | $C_2H_5$— | 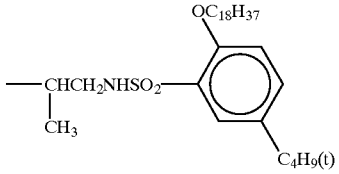 | 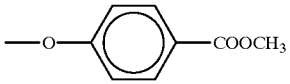 |

-continued
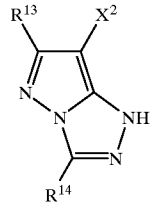
| | $R^{13}$ | $R^{14}$ | $X^2$ |
|---|---|---|---|
| m-9 | $CH_3$— | 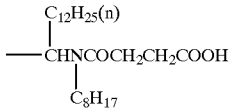 | Cl |
| m-10 | " | 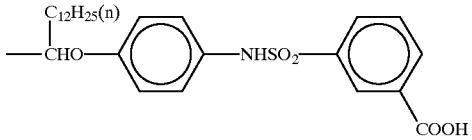 | Cl |
| m-11 | 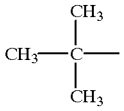 | 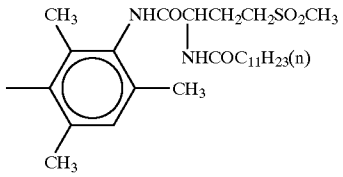 | Cl |
| m-12 | | 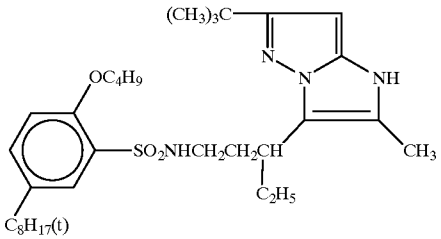 | |

-continued
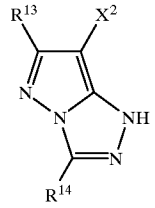
| | $R^{13}$ | $R^{14}$ | $X^2$ |
|---|---|---|---|
| m-13 | | | 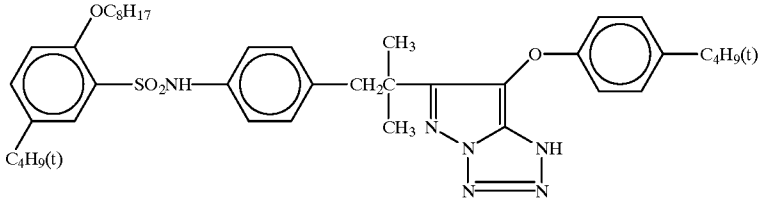 |
| m-14 | | | 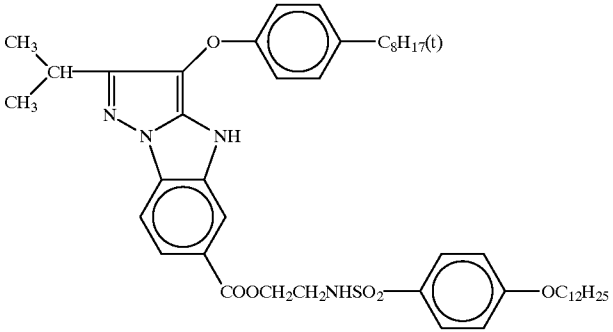 |
| m-15 | | | 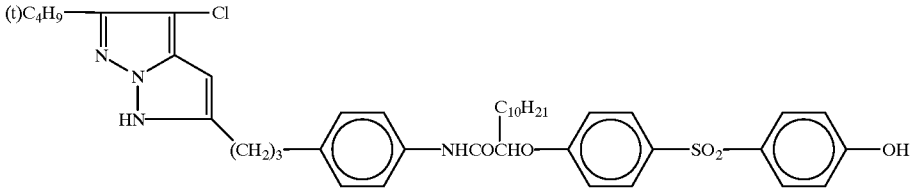 |

Compounds that can release a photographically useful residual group as a result of coupling can also be used in the present invention. As DIR couplers that release a development inhibitor, those described in patents described in Research Disclosure No. 17643, VII-F, as well as JP-A Nos. 151944/1982, 154234/1982, 184248/1985, and 37346/1988, and U.S. Pat. Nos. 4,248,962 and 4,782,012, are preferable.

As couplers that release development accelerators or nucleus-forming agents (nucleators) image-wise at the time of development, those described in British Patent Nos. 2,097,140 and 2,131,188, and JP-A Nos. 157638/1984 and 170840/1984, are preferable.

Further examples of compounds that can be used in the light-sensitive material of the present invention include for example, competing couplers described in U.S. Pat. No. 4,130,427, multi-equivalent couplers described in U.S. Pat. Nos. 4,283,472, 4,338,393, and 4,310,618; DIR redox-compound-releasing couplers, DIR coupler-releasing couplers, DIR coupler-releasing redox compounds, or DIR redox-releasing redox compounds, described in JP-A Nos. 185950/1985 and 24252/1987; couplers capable of releasing color-restorable dyes after split-off, as described in European Patent No. 173302 A, bleach accelerator-releasing couplers described in Research Disclosure Nos. 11449 and 24241 and JP-A No. 201247/1986, ligand-releasing couplers described in U.S. Pat. No. 4,553,477, couplers capable of releasing leuco dyes, as described in JP-A No. 75747/1988, and couplers capable of releasing fluorescent dyes, as described in U.S. Pat. No. 4,774,181.

The standard amount of these color couplers to be used in the present invention is generally in the range of 0.001 to 1 mol per mol of the light-sensitive silver halide; and in the case of yellow couplers, preferably the amount to be used is 0.01 to 0.5 mol per mol of the light-sensitive silver halide; in the case of magenta couplers, preferably the amount to be used is 0.003 to 0.3 mol per mol of the light-sensitive silver halide; and in the case of cyan couplers, preferably the amount to be used is 0.002 to 0.3 mol per mol of the light-sensitive silver halide.

The compound used in the present invention may be used in combination with known anti-fading agents, and in that case the anti-fading effect is further increased. Further, two or more of the compounds represented by formula (I) may be used in combination.

Representative examples of organic anti-fading agents that can be additionally used for cyan, magenta, and/or yellow images include hydroquinones, 6-hydroxychromans, 5-hydroxychromans, spirochromans, p-alkoxyphenols; hindered phenols, including bisphenols; gallic acid derivatives, methylenedioxybenzenes, aminophenols, hindered amines, and ether or ester derivatives obtained by silylating or alkylating the phenolic hydroxyl group of these compounds. Further, for example, metal complexes, represented by (bis-salicylaldoximato) nickel complexes and (bis-N,N-dialkyldithiocarbamato) nickel complexes, can be used.

Specific examples of such organic anti-fading agents include hydroquinones described, for example, in U.S. Pat. Nos. 2,360,290, 2,418,613, 2,700,453, 2,701,197, 2,728,659, 2,732,300, 2,735,765, 3,982,944, and 4,430,425, British Patent No. 1363921, and U.S. Pat. Nos. 2,710,801 and 2,816,028; 6-hydroxychromans, 5-hydroxychromans, and spirochromans, described, for example, in U.S. Pat. Nos. 3,432,300, 3,573,050, 3,574,627, 3,698,909, and 3,764,337, and JP-A No. 152225/1987; spiroindans described in U.S. Pat. No. 4,360,589; p-alkoxyphenols described, for example, in U.S. Pat. No. 2,735,765, British Patent No. 2066975, JP-A No. 10539/1984, and JP-B No. 19765/1982; hindered phenols described, for example, in U.S. Pat. Nos. 3,700,455 and 4,228,235, JP-A No. 72224/1977, and JP-B No. 6623/1977; gallic acid derivatives described in U.S. Pat. No. 3,457,079; methylenedioxybenzenes described in U.S. Pat. No. 4,332,886; aminophenols described in JP-B No. 21144/1981; hindered amines described, for example, in U.S. Pat. Nos. 3,336,135 and 4,268,593, British Patent Nos. 1326889, 1354313, and 1410846, JP-B No. 1420/1976, and JP-A Nos. 114036/1983, 53846/1984, and 78344/1984; and metal complexes described, for example, in U.S. Pat. Nos. 4,050,938 and 4,241,155, and British Patent No. 2027731 (A). These compounds, generally in amounts of 5 to 100% by weight based on the respective corresponding color coupler, are co-emulsified with the couplers and the like and are added to the light-sensitive layer, so that the purpose can be attained.

The silver halide light-sensitive material of the present invention may contain, as antifoggants that prevent color fogging, for example, hydroquinone derivatives, aminophenol derivatives, gallic acid derivatives, and ascrobic acid derivatives. To prevent cyan dye images from being deteriorated with heat and particularly light, it is more effective to introduce an ultraviolet-absorbing agent in the cyan color-forming layer and at least one of opposite layers adjacent to that cyan color-forming layer.

Use can be made of, as the ultraviolet-absorbing agent, benzotriazole compounds substituted by an aryl group (e.g. those described in U.S. Pat. No. 3,533,794), 4-thiazolidone compounds (e.g. those described in U.S. Pat. Nos. 3,314,794 and 3,352,681), benzophenone compounds (e.g. those described in JP-A No. 2784/1971), cinnamate compounds (e.g. those described in U.S. Pat. Nos. 3,705,805 and 3,707,395), butadiene compounds (e.g. those described in U.S. Pat. No. 4,045,229), benzoxazole compounds (e.g. those described in U.S. Pat. Nos. 3,406,070 and 4,271,307), or triazine compounds (e.g. those described in JP-A No. 3335/1971). Ultraviolet-absorbing couplers (e.g. α-naphthol cyan dye-forming couplers), ultraviolet-absorbing polymers, and the like may also be used. These ultraviolet-absorbing agents may be mordanted into a specific layer. In particular, the above benzotriazole compounds substituted by an aryl group are preferable.

The light-sensitive material of the present invention contains at least one compound represented by formula (I) for use in the present invention, in at least one layer on its support (base).

The color light-sensitive material may be constituted in such a way that, generally, at least one blue-sensitive silver halide emulsion layer, at least one green-sensitive silver halide emulsion layer, and at least one red-sensitive silver halide emulsion layer may be applied on a support, in the stated order, but the order may be changed. Further, an infrared-sensitive silver halide emulsion layer can be used in place of at least one of the above light-sensitive emulsion layers. By incorporating, into these light-sensitive emulsion layers, silver halide emulsions sensitive to respective wavelength ranges, and color couplers capable of forming dyes that have complemental relations to the lights to which they are sensitive, color reproduction by the subtractive color process can be effected. That is, the blue-sensitive silver halide emulsion layer contains a non-diffusion yellow coupler capable of forming a non-diffusion yellow dye, the green-sensitive silver halide emulsion layer contains a non-diffusion magenta coupler capable of forming a non-diffusion magenta dye, and the red-sensitive silver halide emulsion layer contains a non-diffusion cyan coupler capable of forming a non-diffusion magenta dye. However, the light-sensitive emulsion layers, and the hues formed by the color couplers, may be different in constitution from the above correspondence.

The light-sensitive material of the present invention can be applied, for example, for black and white films, color papers, color reversal papers, direct positive color light-sensitive materials, color negative films, color positive films, and color reversal films, preferably for color light-sensitive materials having a reflective support (e.g. color papers and color reversal papers) and color light-sensitive materials for positive images (e.g. direct positive color light-sensitive materials, color positive films, and color reversal films), and particularly preferably for color light-sensitive materials having a reflective support.

As the silver halide used in the present invention, for example, silver chloride, silver bromide, silver chlorobromide, silver iodochlorobromide, silver iodobromide, and silver iodochloride can be used. In the case of color negative films, color reversal films, color reversal papers, or the like, wherein high sensitivities are intended mainly for shooting, silver iodochlorobromide, silver iodobromide, and silver iodochloride emulsions having a silver iodide content of 1 to 20 mol % are preferably used. In the case of internal latent image-type direct positive color light-sensitive materials, wherein previous fogging has not be done, silver bromochloride emulsions having a silver bromide content of 50 to 100 mol %, and pure silver bromide emulsions, are preferably used. Further, in the case of color papers or the like that are particularly intended for rapid processing, silver chlorobromide emulsions substantially not containing silver iodide (preferably containing silver iodide in an amount of 1 mol % or less), and having a silver chloride content of 90 to 100 mol %, more preferably 95 to 100 mol %, and particularly preferably 98 to 100 mol %, and pure silver chloride emulsions are preferably used.

In the light-sensitive material of the present invention, for the purpose of improving, for example, the sharpness of images, preferably dyes (particularly oxonol dyes), which can be decolored by processing, as described in European Patent No. 0337490 A2, pages 27 to 76, are added to the hydrophilic colloid layer, in such an amount that the optical reflection density of the light-sensitive material at 680 nm is 0.70 or more. Further, titanium oxide, whose surface has been treated with a bihydric to tetrahydric alcohol (e.g. trimethylolethane) or the like, is preferably added into the water-resistant resin layer of the support, in an amount of 12% by weight or more (more preferably 14% by weight or more).

Further, in the light-sensitive material of the present invention, together with the couplers, preferably use is made of a dye image-preservability-improving compound described in European Patent No. 0277589 A2. In particular, the use of a combination with the above pyrazoloazole coupler or pyrroloazole coupler is preferable.

That is, a compound that can chemically bind to the aromatic amine developing agent remaining after the color development processing, to produce a chemically inactive and substantially colorless compound, and/or a compound that can chemically bind to the oxidization product of the aromatic amine developing agent remaining after the color development processing, to produce a chemically inactive and substantially colorless compound, are preferably used in combination or singly. This is because, for example, such the compound can prevent the occurrence of stain due to the production of color-formed dyes by the reactions of the couplers with the remaining color-developing agent (color-forming reducing agent) or its oxidization product in the film during storage after processing, or it can prevent other side effects.

Further, in the light-sensitive material of the present invention, it is preferable to add a mildew-proofing agent, as described in JP-A No. 271247/1988, into the hydrophilic colloid layer, in order to prevent various mildew and fungi that will deteriorate images from propagating.

Further, as the support used in the light-sensitive material of the present invention, a white polyester support, or a support having a white-pigment-containing layer provided on the side on which silver halide emulsion layers are formed, can be used for display. Further, in order to improve the sharpness, an antihalation layer is preferably applied to the support, on the side on which the silver halide emulsion layers are applied, or to the undersurface of the support. It is particularly preferable to set the transmission density of the support within the range of 0.35 to 0.8, in order to allow the display to be appreciated under reflected light, as well as transmitted light.

The light-sensitive material of the present invention is exposed image-wise, is color-developed, and then is processed with a processing solution having a bleaching capacity (including a bleaching solution and a bleach-fix solution). For this, reference can be made to Research Disclosure No. 17643, pages 28 to 29, and Research Disclosure No. 18716, page 615, the left column to the right column. For example, a color development processing step, a bleaching step, a fixing step, and a washing step can be carried out. Instead of the bleaching step that uses a bleaching solution, and the fixing step that uses a fixing solution, a bleach-fix step that uses a bleach-fix solution can be carried out, or the bleaching step, the fixing step, and the bleach-fix step can be combined in an arbitrary order. Instead of the washing step, a stabilizing step may be carried out, or after the washing step a stabilizing step may be carried out. Further in addition to these steps, a pre-hardening step, its neutralizing step, a stop-fix step, a post-hardening step, an adjusting step, an intensifying step, etc., may be carried out. To obtain a color reversal image, after the image-wise exposure, a first development is carried out, a reverse processing is carried out, and then a color development step and subsequent steps are carried out. Also, in this case, generally an adjusting step is carried out between the color-developing step and the bleaching step. Between the above steps, an intermediate washing step may be arbitrarily carried out.

As silver halide emulsions, as other materials (additives and the like), and as photographic constitutional layers (including the arrangement of layers), each of which are applied to the present invention, and as processing methods and processing additives, which are applied for processing the light-sensitive material, those described in patent publications in Tables shown below, and European Patent No. 0519190 A2, are preferably used, and those described in European Patent No. 0355660 A2 are particularly preferably used.

| Element constituting photographic material | JP-A No. 215272/1987 | JP-A No. 33144/1990 | EP 0,355,660A2 |
|---|---|---|---|
| Silver halide emulsion | p. 10 upper right column line 6 to p. 12 lower left column line 5, and p. 12 lower right column line 4 froin the bottom to p. 13 upper left column line 17 | p. 28 upper right column line 16 to p. 29 lower right column line 11 and p. 30 lines 2 to 5 | p. 45 line 53 to p. 47 line 3 and lines 20 to 22 p. 47 |
| Solvent for silver halide | p. 12 lower left column lines 6 to 14 and p. 13 upper left column line 3 from the bottom to p. 18 lower left column last line | — | — |
| Chemical sensitizing agent | p. 12 lower left column line 3 from the bottom to lower right column line 5 from the bottom and p. 18 lower right column line 1 to p. 22 upper right column line 9 from the bottom | p. 29 lower right column line 12 to last line | p. 47 lines 4 to 9 |
| Spectral sensitizing agent (method) | p. 22 upper right column line 8 from the bottom to p. 33 last line | p. 30 upper left column lines 1 to 13 | p. 47 lines 10 to 15 |
| Emulsion stabilizer | p. 39 upper left column line 1 to p. 72 upper right column last line | p. 30 upper left column line 14 to upper right column line 1 | p. 47 lines 16 to 19 |
| Developing accelerator | p. 72 lower left column line 1 to p. 91 upper right column line 3 | — | — |
| Color coupler (Cyan, Magenta, and Yellow coupler) | p. 91 upper right column line 4 to p. 121 upper left column line 6 | p. 3 upper right column line 14 to p. 18 upper left column last line and p. 30 upper right column line 6 to p. 35 lower right column line 11 | p. 4 lines 15 to 27, p. 5 line 30 to p. 28 last line, p. 45 lines 29 to 31 and p. 47 line 23 to p. 63 line 50 |
| Color Formation-strengthening agent | p. 121 upper left column line 7 to p. 125 upper right column line 1 | — | — |
| Ultraviolet absorbing agent | p. 125 upper right column line 2 to p. 127 lower left column last line | p. 37 lower right column line 14 to p. 38 upper left column line 11 | p. 65 lines 22 to 31 |
| Fading (discoloration) inhibitor (Image-dye stabilizer) | p. 127 lower right column line 1 to p. 137 lower left column line 8 | p. 36 upper right column line 12 to p. 37 upper left column line 19 | p. 4 line 30 to p. line 23, p. 29 line 1 to p. 45 line 25 p. 45 lines 33 to 40 and p. 65 lines 2 to 21 |
| High-boiling and/or low-boiling organic solvent | p. 137 lower left column line 9 to p. 144 upper right column last line | p. 35 lower right column line 14 to p. 36 upper left column line 4 from the bottom | p. 64 lines 1 to 51 |
| Method for dispersing additives for photograph | p. 144 lower left column line 1 to p. 146 upper right column line 7 | p. 27 lower right column line 10 to p. 28 upper left column last line and p. 35 lower right column line 12 to p. 36 upper right column line 7 | p. 63 line 51 to p. 64 line 56 |
| Film Hardener | p. 146 upper right column line 8 to p. 155 lower left column line 4 | — | — |
| Developing Agent precursor | p. 155 lower left column line 5 to p. 155 lower right column line 2 | — | — |

-continued

| Element constituting photographic material | JP-A No. 215272/1987 | JP-A No. 33144/1990 | EP 0,355,660A2 |
|---|---|---|---|
| Compound development releasing inhibitor | p. 155 lower right column lines 3 to 9 | — | — |
| Support | p. 155 lower right column line 19 to p. 156 upper left column line 14 | p. 38 upper right column line 18 to p. 39 upper left column line 3 | p. 66 line 29 to p. 67 line 13 |
| Constitution of photosensitive layers | p. 156 upper left column line 15 to p. 156 lower right column line 14 | p. 28 upper right column lines 1 to 15 | p. 45 lines 41 to 52 |
| Dye | p. 156 lower right column line 15 to p. 184 lower right column last line | p. 38 upper left column line 12 to upper right column line 7 | p. 66 lines 18 to 22 |
| Color-mixing inhibitor | p. 185 upper left column line 1 to p. 188 lower right column line 3 | p. 36 upper right column lines 8 to 11 | p. 64 line 57 to p. 65 line 1 |
| Gradation controller | p. 188 lower right column lines 4 to 8 | — | — |
| Stain inhibitor | p. 188 lower right column line 9 to p. 193 lower right column line 10 | p. 37 upper left column last line to lower right column line 13 | p. 65 line 32 to p. 66 line 17 |
| Surface-active agent | p. 201 lower left column line 1 to p. 210 upper right column last line | p. 18 upper right column line 1 to p. 24 lower right column last line and p. 27 lower left column line 10 from the bottom to lower right column line 9 | — |
| Fluorine-containing agent (As Antistatic agent, coating aid, lubricant, adhesion inhibitor, or the like) | p. 210 lower left column line 1 to p. 222 lower left column line 5 | p. 25 upper left column line 1 to p. 27 lower right column line 9 | — |
| Binder (Hydrophilic colloid) | p. 222 lower left column line 6 to p. 225 upper left column last line | p. 38 upper right column lines 8 to 18 | p. 66 lines 23 to 28 |
| Thickening agent | p. 225 upper right column line 1 to p. 227 upper right column line 2 | — | — |
| Antistatic agent | p. 227 upper right column line 3 to p. 230 upper left column line 1 | — | — |
| Polymer latex | p. 230 upper left column line 2 to p. 239 last line | — | — |
| Matting agent | p. 240 upper left column line 1 to p. 240 upper right column last line | — | — |
| Photographic processing method (processing process, additive, etc.) | p. 3 upper right column line 7 to p. 10 upper right column line 5 | p. 39 upper left column line 4 to p. 42 upper left column last line | p. 67 line 14 to p. 69 line 28 |

Note:
In the cited portions of JP-A No. 215272/1987, the contents that are amended by the amendment filed on March 16, 1987, which amendment is shown in the last of the publication, are also included. Further, among the above-mentioned color couplers, it is also preferable to use a so called short wavelength-type yellow coupler, described in JP-A Nos. 231451/1988, 123047/1988, 241547/1988, 173499/1989, 213648/1989, and 250944/1989, as a yellow coupler.

The silver halide color photographic light- sensitive material of the present invention exhibits excellent effects: it is excellent in the solubility and dispersion stability of photographic reagents that are used for it; it is good in color reproducibility; and it gives images that are excellent in the fastness of dye images.

Now, the present invention is explained in more detail below by referring to examples, but the present invention is not limited to these examples shown.

EXAMPLE

Example 1

A paper base, both surfaces of which had been laminated with a polyethylene, was subjected to surface corona discharge treatment; then it was provided with a gelatin undercoat layer containing sodium dodecylbenzensulfonate, and it was coated with various photographic constitutional layers, to produce a multi-layer photographic color printing paper (101) having the layer constitution shown below.

The coating solutions were prepared as follows.

Preparation of Fifth-Layer Coating Solution 10 g of a cyan coupler (C-1) of formula (I) was dissolved in 20 g of a solvent (Solv-8), 3 g of a color image stabilizer (Cpd-8), 10 g of a color image stabilizer (Cpd-13) and 50 ml of ethyl acetate, and the resulting solution was emulsified and dispersed in 400 g of a 12% aqueous gelatin solution containing 1.2 g of a surface-active agent (Cpd-12), to prepare an emulsion C having the average grain size of 0.18 μm.

On the other hand, a silver chlorobromide emulsion C (cubes; a mixture of a large-size emulsion C having an average grain size of 0.50 μm, and a small-size emulsion C having an average grain size of 0.41 μm (1:4 in terms of mol of silver), the deviation coefficients of the grain size distributions being 0.09 and 0.11, respectively, and each emulsion having 0.8 mol % of silver bromide locally contained in part of the grain surface whose substrate was made up of silver chloride) was prepared. To the large-size emulsion C of this emulsion, had been added $5.0\times10^{-5}$ mol, per mol of silver, of each of red-sensitive sensitizing dyes G and H shown below, and to the small-size emulsion C of this emulsion, had been added $8.0\times10^{-5}$ mol, per mol of silver, of each of red-sensitive sensitizing dyes G and H shown below. Further, additive X was added in an amount of $2.6\times10^{-3}$ mol per mol of silver halide. The chemical ripening of this emulsion was carried out optimally with a sulfur sensitizer and a gold sensitizer being added.

The above emulsified dispersion C and this silver chlorobromide emulsion C were mixed and dissolved, and a fifth-layer coating solution was prepared so that it would have the composition shown below. For the silver halide emulsions, the amounts to be applied are given in terms of silver.

The coating solutions for the first to fourth, sixth and seventh layers were prepared in the similar manner as in the fifth-layer coating solution. These coating solutions were coated after 15 minutes from the preparation. As the gelatin hardener for each layer, 1-oxy-3,5-dichloro-s-triazine sodium salt was used.

Further, to each layer, were added AS-1, AS-2, AS-3, and AS-4, so that the total amounts would be 15.0 mg/m$^2$, 6.0 mg/m$^2$, 5.0 mg/m$^2$, and 10.0 mg/m$^2$, respectively.

(AS-1) Antiseptic

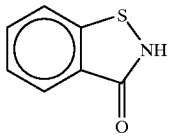

(AS-2) Antiseptic

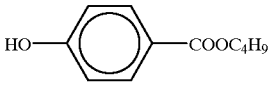

-continued (AS-3) Antiseptic

Mixture in 1:1:1:1 (weight ratio) of a, b, c and d

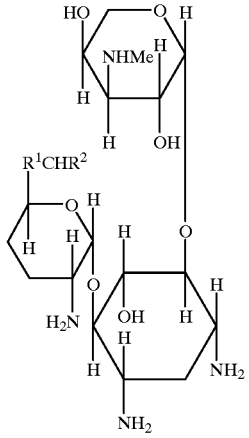

| | $R^1$ | $R^2$ |
|---|---|---|
| a | —Me | —NHMe |
| b | —Me | —$NH_2$ |
| c | —H | —$NH_2$ |
| d | —H | —NHMe |

(AS-4) Antiseptic

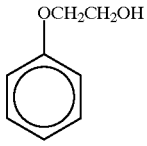

For the silver chlorobromide emulsion of each photosensitive emulsion layer, the following spectrally sensitizing dyes were used.

Blue-Sensitive Emulsion Layer

Sensitizing dye A

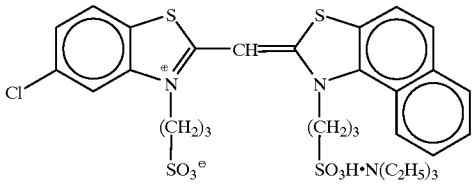

Sensitizing dye B

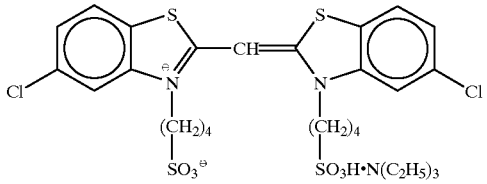

Sensitizing dye C

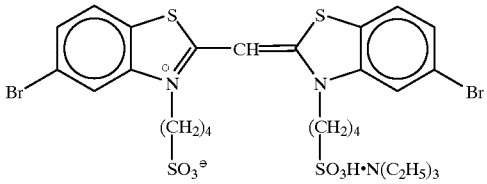

(Each was added to the large-size emulsion in an amount of $1.4\times10^{-4}$ mol per mol of the silver halide, and to the small-size emulsion in an amount of $1.7\times10^{-4}$ mol per mol of the silver halide.)

Green-Sensitive Emulsion Layer

Sensitizing dye D

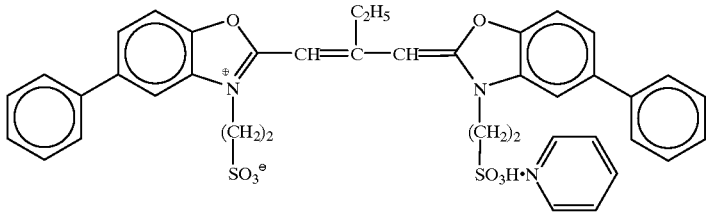

Sensitizing dye E

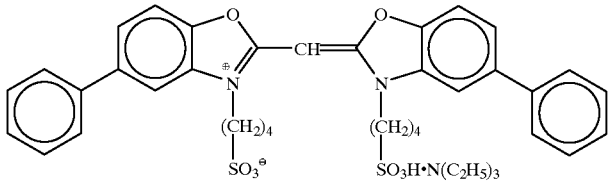

Sensitizing dye F

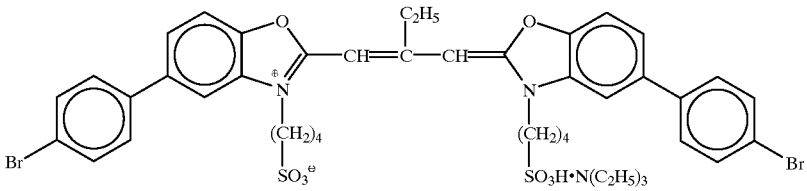

(The sensitizing dye D was added to the large-size emulsion in an amount of $3.0\times10^{-4}$ mol, per mol of silver halide, and to the small-size emulsion in an amount of $3.6\times10^{-4}$ mol, per mol of silver halide; the sensitizing dye E was added to the large-size emulsion in an amount of $4.0\times10^{-5}$ mol, per mol of silver halide, and to the small-size emulsion in an amount of $7.0\times10^{-5}$ mol, per mol of silver halide; the sensitizing dye F was added to the large-size emulsion in an amount of $2.0\times10^{-4}$ mol, per mol of silver halide, and to the small-size emulsion in an amount of $2.8\times10^{-4}$ mol, per mol of silver halide.)

Red-Sensitive Emulsion Layer

Sensitizing dye G

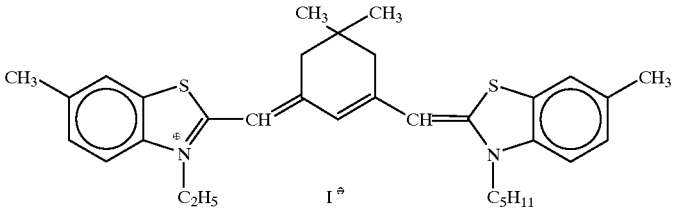

Sensitizing dye H

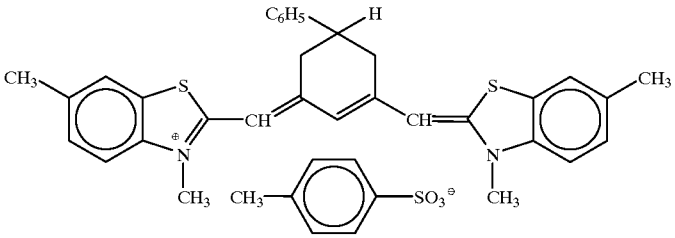

(Each was added to the large-size emulsion in an amount of $5.0\times10^{-5}$ mol, per mol of the silver halide, to the small-size emulsion in an amount of $8.0\times10^{-5}$ mol, per mol of the silver halide.)

Further, the following compound was added to the red-sensitive emulsion layer in an amount of $2.6\times10^{-3}$ mol per mol of the silver halide.

Additive X

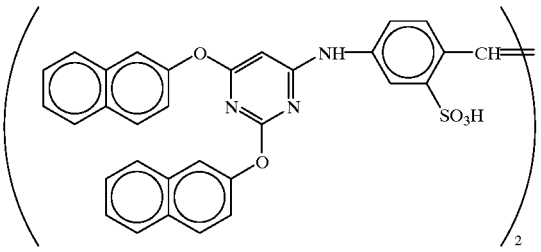

To the blue-sensitive emulsion layer, the green-sensitive emulsion layer, and the red-sensitive emulsion layer, was added 1-(5-methylureidophenyl)-5-mercaptotetrazole in amounts of $3.3\times10^{-4}$ mol, $1.0\times10^{-3}$ mol, and $5.9\times10^{-4}$ mol, respectively, per mol of the silver halide.

Further, to the second layer, the forth layer, the sixth layer and the seventh layer, was added 1-(5-methylureidophenyl)-5-mercaptotetrazole, so that the added amounts would be 0.2 mg/m$^2$, 0.2 mg/m$^2$, 0.6 mg/m$^2$, and 0.1 mg/m$^2$, respectively.

Further, to the blue-sensitive emulsion layer and the green-sensitive emulsion layer, were added 4-hydroxy-6-methyl-1,3,3a,7-tetrazaindene in amounts of $1\times10^{-4}$ mol and $2\times10^{-4}$ mol, respectively, per mol of the silver halide.

Further, as a water-soluble dye to prevent irradiation, the following compounds were added to the second, forth and sixth layers in the divided amounts.

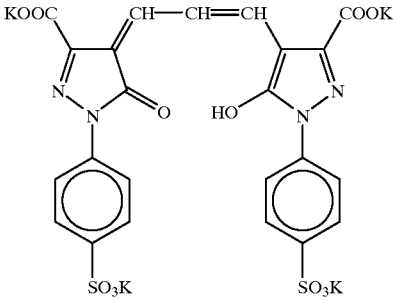

(10 mg/m$^2$)

and

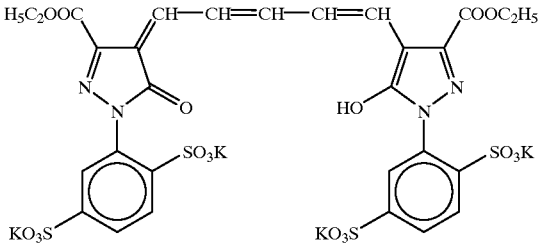

(40 mg/m$^2$)

and

-continued

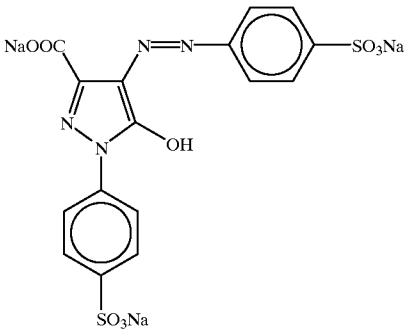

(5 mg/m$^2$)

Layer Constitution

The composition of each layer is shown below. The numbers show coating amounts (g/m$^2$). In the case of the silver halide emulsion, the coating amount is in terms of silver.

Support

Polyethylene-Laminated Paper

The polyethylene on the first layer side contained a white pigment ($TiO_2$ content of 15 wt %) and a blue dye (ultramarine)

| First Layer (Blue-Sensitive Emulsion Layer) | |
|---|---|
| A silver chlorobromide emulsion A (cubes, a mixture of a large-size emulsion A having an average grain size of 0.88 μm, and a small-size emulsion A having an average grain size of 0.70 μm (3:7 in terms of mol of silver). The deviation coefficients of the grain size distributions were 0.08 and 0.10, respectively, and each emulsion had 0.3 mol % of AgBr locally contained in part of the grain surface whose substrate was made up of silver chloride.) | 0.26 |
| Gelatin | 1.4 |
| Yellow coupler (ExY) | 0.64 |
| Color image stabilizer (Cpd-1) | 0.078 |
| Color image stabilizer (Cpd-2) | 0.038 |
| Color image stabilizer (Cpd-3) | 0.085 |
| Color image stabilizer (Cpd-5) | 0.020 |
| Color image stabilizer (Cpd-9) | 0.0050 |
| Solvent (Solv-1) | 0.11 |
| Solvent (Solv-6) | 0.11 |
| **Second Layer (Color-Mixing Inhibiting Layer** | |
| Gelatin | 1.0 |
| Color-mixing inhibitor (Cpd-4) | 0.11 |
| Solvent (Solv-1) | 0.065 |
| Solvent (Solv-2) | 0.22 |
| Solvent (Solv-3) | 0.080 |
| Solvent (Solv-7) | 0.10 |
| Ultraviolet absorbing agent (UV-B) | 0.070 |
| **Third Layer (Green-Sensitive Emulsion Layer)** | |
| A silver chlorobromide emulsion (cubes, a mixture of a large-size emulsion B having an average grain size of 0.55 μm, and a small-size emulsion B having an average grain size of 0.39 μm (1:3 in terms of mol of silver). The deviation coefficients of the grain size distributions were 0.10 and 0.08, respectively, and each emulsion had 0.7 mol % of AgBr locally contained in part of the grain | 0.11 |

-continued

| | |
|---|---|
| surface whose substrate was made up of silver chloride.) | |
| Gelatin | 1.3 |
| Magenta coupler (M-1) | 0.13 |
| Ultraviolet absorbing agent (UV-A) | 0.12 |
| Color image stabilizer (Cpd-2) | 0.010 |
| Color image stabilizer (Cpd-5) | 0.020 |
| Color image stabilizer (Cpd-6) | 0.010 |
| Color image stabilizer (Cpd-7) | 0.080 |
| Color image stabilizer (Cpd-8) | 0.030 |
| Color image stabilizer (Cpd-10) | 0.0020 |
| Solvent (Solv-3) | 0.15 |
| Solvent (Solv-4) | 0.22 |
| Solvent (Solv-5) | 0.11 |

Fourth Layer (Color-Mixing Inhibiting Layer)

| | |
|---|---|
| Gelatin | 1.0 |
| Color-mixing inhibitor (Cpd-4) | 0.11 |
| Solvent (Solv-1) | 0.065 |
| Solvent (Solv-2) | 0.22 |
| Solvent (Solv-3) | 0.080 |
| Solvent (Solv-7) | 0.010 |
| Ultraviolet absorbing agent (UV-B) | 0.070 |

Fifth Layer (Red-Sensitive Emulsion Layer)

| | |
|---|---|
| A silver chlorobromide emulsion (cubes, a mixture of a large-size emulsion having an average grain size of 0.50 $\mu$m, and a small-size emulsion having an average grain size of 0.41 $\mu$m (1:4 in terms of mol of silver). The deviation coefficients of the grain size distributions were 0.09 and 0.11, respectively, and each emulsion had 0.8 mol % of AgBr locally contained in part of the grain surface whose substrate was made up of silver chloride.) | 0.085 |
| Gelatin | 0.99 |
| Cyan coupler (C-1) | 0.15 |

-continued

| | |
|---|---|
| Solvent (Solv-8) | 0.30 |
| Color image stabilizer (Cpd-8) | 0.05 |
| Color image stabilizer (Cpd-13) | 0.15 |

Sixth Layer (Ultraviolet Absorbing Layer)

| | |
|---|---|
| Gelatin | 0.63 |
| Ultraviolet absorbing agent (UV-C) | 0.35 |
| Color image stabilizer (Cpd-7) | 0.050 |
| Solvent (Solv-9) | 0.050 |

Seventh Layer (Protective Layer)

| | |
|---|---|
| Gelatin treated with acid | 1.0 |
| Acryl-modified copolymer of polyvinyl alcohol (modification degree: 17%) | 0.043 |
| Liquid paraffin | 0.018 |
| Surface-active agent (Cpd-11) | 0.026 |

(ExY) Yellow coupler (ExY-1)

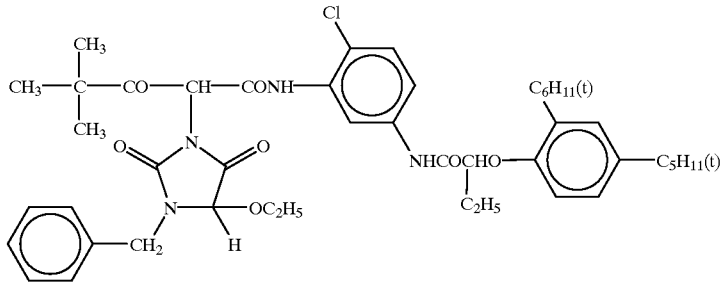

(ExY-2)

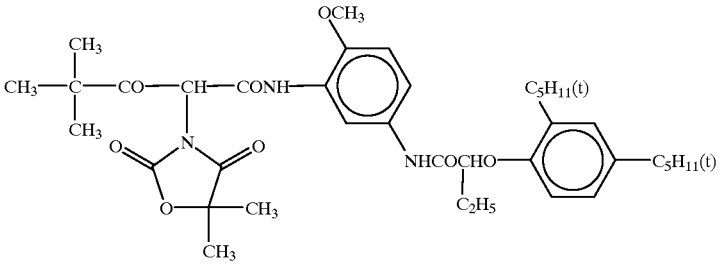

-continued (ExY-3)

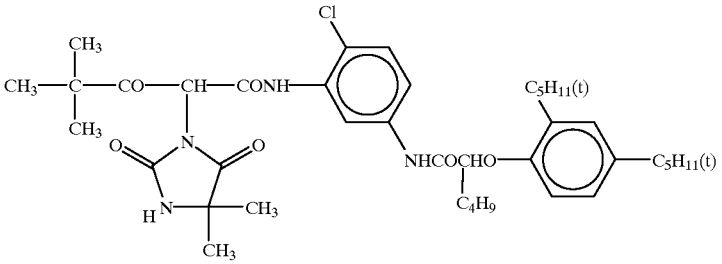

Mixture in a molar ratio of 1:1:1

(Cpd-1) Color-image stabilizer

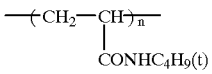

Average molecular weight of 60,000

(Cpd-2) Color-image stabilizer

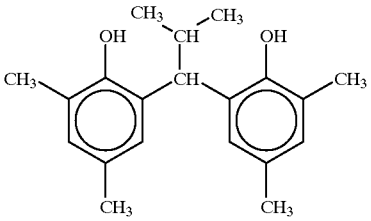

(Cpd-3) Color-image stabilizer

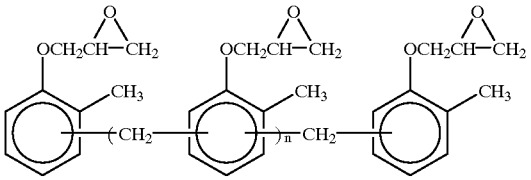

($n$ = 0~15, average value 7~8)

(Cpd-4) Color-mixing inhibitor

Mixture in 1:1:1 (weight ratio) of

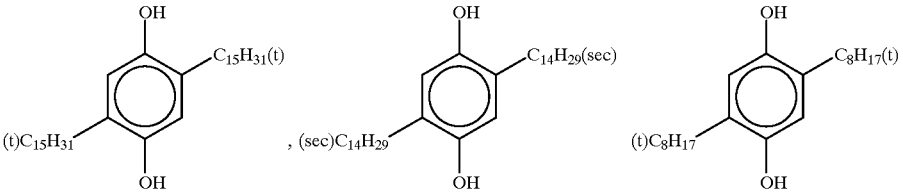

(Cpd-5) Color-image stabilizer

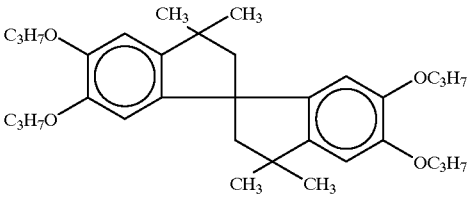

(Cpd-6) Color-image stabilizer

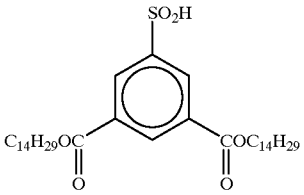

(Cpd-7) Color-image stabilizer

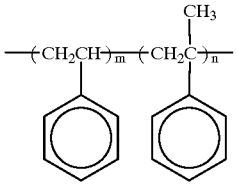

Number average molecular weight of 600

$m/n$ = 10/90

(Cpd-8) Color-image stabilizer

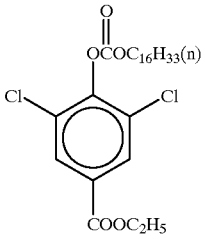

-continued
(Cpd-9) Color-image stabilizer
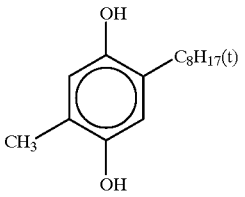
(Cpd-10) Color-image stabilizer
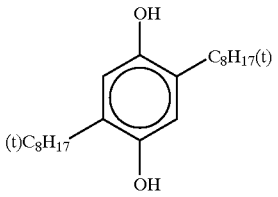
(Cpd-11) Surface-active agent
(1)
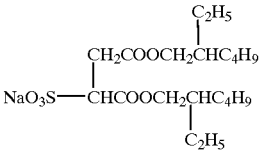
(2)
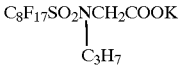
(3)
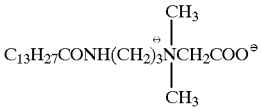
Mixture in 3:1:3 (weight ratio) of (1), (2) and (3)
(Cpd-12) Surface-active agent
(1)
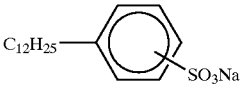
(2)
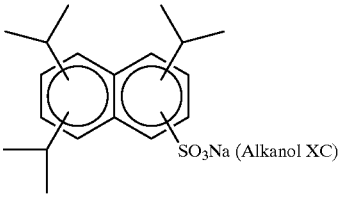
Mixture in 1:1 of (1) and (2)
(Cpd-13)
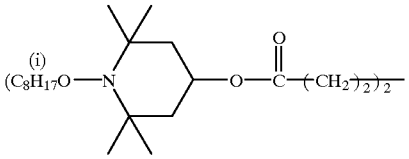
(Solv-1) Solvent
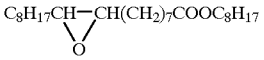
(Solv-2) Solvent
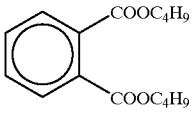
(Solv-3) Solvent
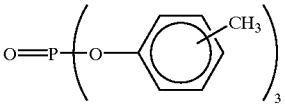
(Solv-4) Solvent
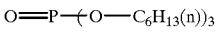
(Solv-5) Solvent
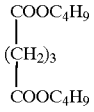
(Solv-6) Solvent
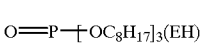
(Solv-7) Solvent
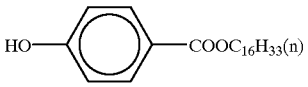

-continued
(Solv-8) Solvent
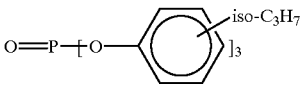
(Solv-9) Solvent
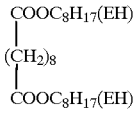
(UV-A) Ultra-violet absorbent
(1)
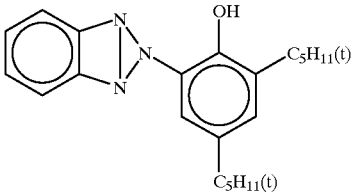
(2)
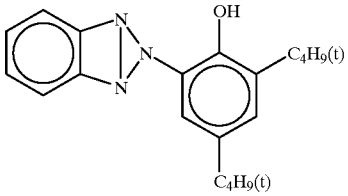
(3)
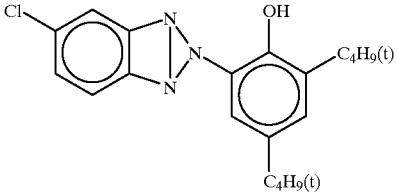
(4)
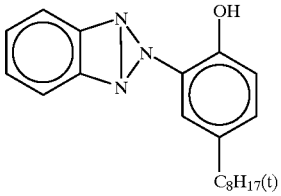
Mixture in 5:2:2:1 (weight ratio) of (1), (2), (3) and (4)
(UV-B) Ultra-violet absorbent
(1)
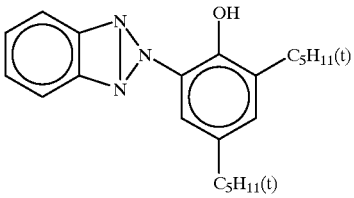
(2)
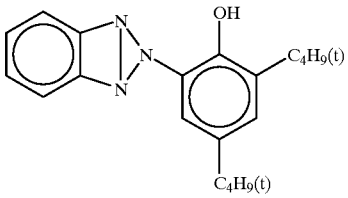
(3)
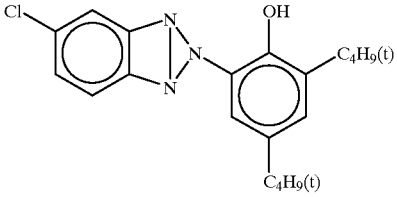
(4)
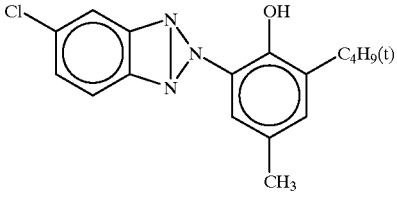
(5)
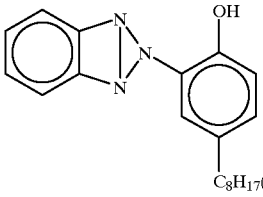
Mixture in 5:2:2:2:1 (weight ratio) of (1), (2), (3), (4) and (5)
(UV-C) Ultra-violet absorbent
(1)
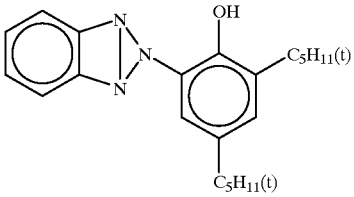
(2)
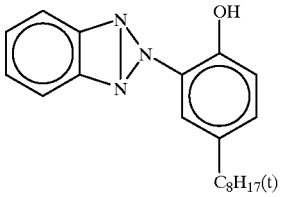

-continued (3)

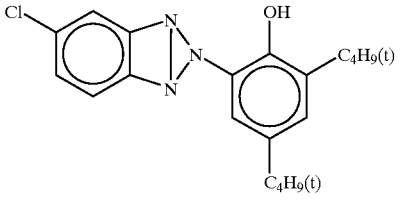

(4)

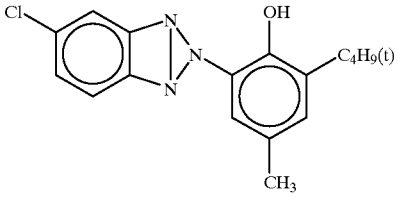

(5)

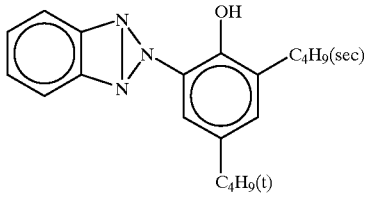

(6)

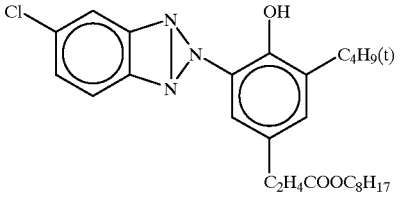

Mixture in 6:2:2:2:3:1 (weight ratio) of (1), (2), (3), (4), (5) and (6)

Comparative additive

CS-1

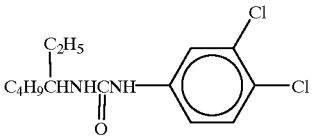

Compound descried in
European Patent Publication No. 309158

CS-2

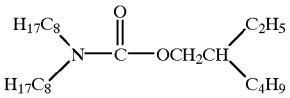

Compound described in JP-A No. 258800/1994

CS-3

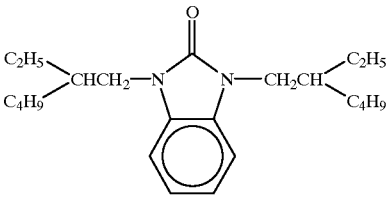

Compound described in JP-A No. 258801/1994

Light-Sensitive Materials 102 to 118 were prepared in the same manner as in Light-Sensitive Material 101 prepared above, except that the composition in the fifth layer was changed as shown in Table 1 below. In Samples 102 to 118, as is shown in Table 1, the addition of the compound for use in the present invention (Samples 102 to 115), the addition of comparative compound (Samples 116 to 118), and the change of coupler, etc., were conducted.

The average particle sizes of the coupler-containing lipophilic fine particles prepared in the production of these samples were all in the range of 0.17 to 0.19 $\mu$m. The thus-prepared coated samples were subjected to the evaluation described below, after storage for 14 days at room temperature.

First, Light-Sensitive Material 102 was exposed to light image-wise, so that about 30% of the coated amount of silver might be developed, and it was continuously processed using a paper processor until the replenishment rate of the color-developing solution in the following processing steps became twice the volume of the tank.

| Processing step | Temperature | Time | Replenishment rate | Tank volume |
|---|---|---|---|---|
| Color development | 38.5° C. | 45 sec | 73 ml | 500 ml |
| Bleach fix | 30–35° C. | 45 sec | 60 ml | 500 ml |
| Rinse (1) | 30–35° C. | 20 sec | — | 500 ml |
| Rinse (2) | 30–35° C. | 20 sec | — | 500 ml |
| Rinse (3) | 30–35° C. | 20 sec | 370 ml | 500 ml |
| Drying | 70–80° C. | 60 sec | | |

*The replenishment rate was the amount per $m^2$ of the light-sensitive material.

(the rinse was conducted in a 3-tank counter-current system of Rinse (3) to Rinse (1))

The composition of each processing solution is shown below.

| Color Developing Solution | Tank solution | Replenisher |
|---|---|---|
| Water | 700 ml | 700 ml |
| Sodium triisopropylene (β)-sulfonate | 0.1 g | 0.1 g |
| Ethylenediaminetetraacetic acid | 3.0 g | 3.0 g |

-continued

| Color Developing Solution | Tank solution | Replenisher |
|---|---|---|
| Disodium 1,2-dihydroxybenzene-4,6-disulfonate | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |
| Fluorescent whitening agent (WHITEX 4, made by Sumitomo Chemical Ind. Co.) | 1.0 g | 3.0 g |
| Sodium sulfite | 0.1 g | 0.1 g |
| Diethylhydroxylamine | 1.0 g | 1.0 g |
| Disodium-N,N-bis(sulfonatoethyl)-hydroxylamine | 10.0 g | 13.0 g |
| N-ethyl-N-(β-methane-sulfonamidoethyl)-3-methyl-4-aminoaniline sulfate | 5.0 g | 11.5 g |
| Water to make | 1000 ml | 1000 ml |
| pH (25° C.) | 10.0 | 11.0 |
| Bleach-fixing solution (Both tank solution and replenisher) | | |
| Water | | 600 ml |
| Ammonium thiosulfate (700 g/liter) | | 100 ml |
| Ammonium sulfite | | 40 g |
| Etylenediaminetetraacetic acid iron (III) ammonium | | 55 g |
| Ethylenediaminetetraacetic acid iron disodium | | 5 g |
| Ammonium bromide | | 40 g |
| Nitric acid (67%) | | 30 g |
| Water to make | | 1000 ml |
| pH (25° C.) | | 4.8 |

(pH was adjusted by acetic acid and aqueous ammonium)

Rinse solution (Both tank solution and replenisher)

Ion-exchanged water (calcium and magnesium each were 3 ppm or below)

Then, the respective samples were subjected to gradation exposure to light through a three-color separation optical wedge for sensitometry using a sensitometer (FWH type, manufactured by Fuji Photo Film Co., Ltd.; color temperature of the light source: 3,200° K.). This exposure was carried out such that the exposure amount would be 250 CMS by the exposure time of 0.1 sec.

These samples were subjected to the following evaluations:

Evaluation I (color reproducibility)

Each of the exposed sample was processed with the above running solutions using the paper processor. With respect to the cyan color-formed part (red-exposed part) of each of the processed samples, the absorption spectrum at the part where the absorbance at the maximum absorption wavelength was 1.0, was measured. The absorbance at 600 nm of the spectrum was designated as $D_{600\ nm}$, which was used for the scale of association. The smaller the value of $D_{600\ nm}$ is, the smaller the association of dyes is.

Evaluation II (fastness to light)

Each of the samples processed in the processing steps in Evaluation I was irradiated with light for 9 days using a high-intensity xenon irradiator of 200,000 lux. During the irradiation, a heat-absorbing filter and an ultraviolet-absorbing filter, in the latter filter the light transmittance at 360 nm being 50%, were used. The cyan density residual rates (%) after the irradiation with light, at the points where the cyan densities before the irradiation with light were 2.0 and 0.5, were found, to evaluate fastness to light.

The results of the evaluation are shown in Table 1.

TABLE 1

| Sample | Coupler | Additive | Weight ratio to Solv-8 | $D_{600\ nm}$(*) | Residual rate from fading D = 2.0 | Residual rate from fading D = 0.5 | Remarks |
|---|---|---|---|---|---|---|---|
| 101 | C-1 | — | — | 1.0 | 79% | 68% | Comparative example |
| 102 | " | 5 | 0.5 | 0.86 | 85 | 79 | This invention |
| 103 | " | 6 | 0.5 | 0.8 9 | 83 | 75 | This invention |
| 104 | " | 7 | 0.5 | 0.90 | 84 | 74 | This invention |
| 105 | " | 18 | 0.5 | 0.83 | 88 | 80 | This invention |
| 106 | " | 19 | 0.5 | 0.86 | 86 | 78 | This invention |
| 107 | " | 20 | 0.5 | 0.88 | 85 | 77 | This invention |
| 108 | " | 25 | 0.5 | 0.88 | 86 | 78 | This invention |
| 109 | C-4 | 27 | 0.5 | 0.86 | 84 | 78 | This invention |
| 110 | " | 30 | 0.5 | 0.87 | 83 | 77 | This invention |
| 111 | " | 38 | 0.5 | 0.87 | 84 | 79 | This invention |
| 112 | " | 39 | 0.5 | 0.86 | 85 | 80 | This invention |
| 113 | C-1 | 5 | 1.0 | 0.74 | 88 | 84 | This invention |
| 114 | " | 5 | 1.5 | 0.72 | 90 | 85 | This invention |
| 115 | " | 5 | 2.0 | 0.68 | 90 | 85 | This invention |
| 116 | " | CS-1 | 0.5 | 0.9 2 | 70 | 65 | Comparative example |
| 117 | " | CS-2 | 0.5 | 0.9 5 | 65 | 64 | Comparative example |
| 118 | " | CS-3 | 0.5 | 0.89 | 60 | 61 | Comparative example |

(*) The absorbance at 600 nm in the absorption spectrum when the additive was not added, was to be 1.0.

As is apparent from the results shown in Table 1, it can be understood that, in comparison with Sample 101, wherein a high-boiling organic solvent only was used, and the samples wherein CS-1, CS-2, or CS-3, falling outside the present invention, was respectively added, Samples 102 to 115, wherein the compound according to the present invention was added, gave values small in $D_{600\ nm}$, which indicated that the association of dyes could be suppressed. This feature was remarkable when the added amount was large. When the compound for use the present was used, it can be understood that the fastness to light was excellent not only in the high density part but also in the low density part.

Example 2

Sample 301 was prepared in the same manner as sample 401 in Example 4 of JP-A No. 359249/1992, except that in place of the high-boiling organic solvent Oil-1 (dibutyl phthalate) in the ninth layer of the multi-layer color reversal light-sensitive material sample 401, Compound 6 (0.1 g/m$^2$) according to the present invention was used, Compound 6 according to the present invention was added to the tenth layer in an amount of 0.05 g/m$^2$, and in place of the high-boiling organic solvent Oil-1 (dibutyl phthalate) in the eleventh layer, Compound 6 (0.08 g/m$^2$) according to the present invention was used. Sample 301 was slit to have a width of 35 mm, and the resulting strip was perforated in the same format as that of the commercially available film, it was then exposed to light uniformly, and it was processed according to Process No. 11 of the Example 4 using a suspended-type automatic processor. The excellent hue and dye-image fastness were observed on the sample.

Having described our invention as related to the present embodiments, it is our intention that the invention not be limited by any of the details of the description, unless otherwise specified, but rather be construed broadly within its spirit and scope as set out in the accompanying claims.

What is claimed is:

1. A silver halide color photographic light-sensitive material, comprising a non-color-forming compound represented by formula (I) contained in at least one hydrophilic colloid layer on a support:

formula (I)

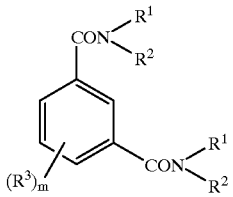

wherein $R^1$ or $R^2$ each represent an aliphatic group, an aromatic group, or a heterocyclic group; $R^3$ represents an aryl group, an alkyl group, a hydroxyl group, a halogen atom, a carbamoyl group, an alkoxycarbonyl group, an acylamino group, a sulfonamido group, a ureido group, an alkylamino group, an alkoxy group, an aryloxy group, an alkylthio group, an arylthio group, a nitro group, a cyano group, a sulfonyl group, a carboxyl group, or a phosphono group; m is an integral number of 0 to 4; and $R^1$ and $R^2$ may bond together to form a ring.

2. The silver halide color photographic light-sensitive material as claimed in claim 1, wherein $R^3$ represents an aryl group, an alkyl group, a carbamoyl group, an acylamino group, a ureido group, or an alkoxy group.

3. The silver halide color photographic light-sensitive material as claimed in claim 1, wherein the layer containing at least one compound represented by formula (I) contains at least one cyan coupler represented by formula (II), or at least one magenta coupler represented by formula (III):

formula (II)

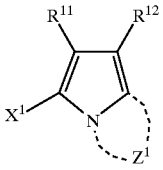

-continued formula (III)

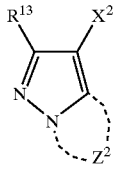

wherein $Z^1$ and $Z^2$ each represent a group of nonmetal atoms required to form an azole ring whose hetero atom is a nitrogen atom, $R^{11}$ and $R^{12}$ each represent an electron-attractive group whose Hammett substituent constant $\sigma_p$ value is 0.30 or more, $R^{13}$ represents a hydrogen atom or a substituent, and $X^1$ and $X^2$ each represent a hydrogen atom or a group capable of being released upon the coupling reaction with the oxidization product of a color-developing agent.

4. The silver halide color photographic light-sensitive material as claimed in claim 3, wherein the azole ring formed by $Z^1$ or $Z^2$ is selected from the group consisting of (Z-1)

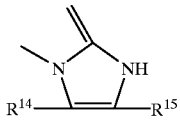

(Z-2)

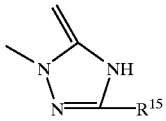

(Z-3)

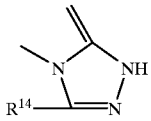

(Z-4)

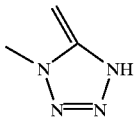

(Z-5)

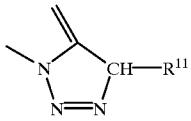

(Z-6)

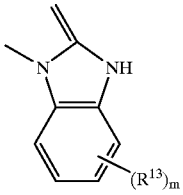

-continued (Z-7)

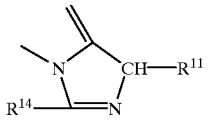

(Z-8)

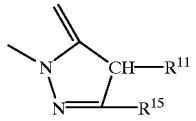

wherein $R^{14}$ and $R^{15}$ each represent a hydrogen atom or a substituent and m is an integral number of 1 to 4.

5. The silver halide color photographic light-sensitive material as claimed in claim 4, wherein the azole ring formed by $Z^1$ or $Z^2$ is (Z-2)

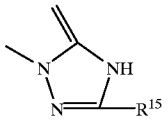

or (Z-3)

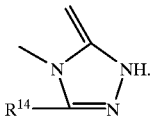

6. The silver halide color photographic light-sensitive material as claimed in claim 4, wherein $R^{13}$, $R^{14}$ and $R^{15}$ each represent a hydrogen atom, an aryl group, an alkyl group, a cyano group, a formyl group, an acyl group, a carbamoyl group, an alkoxycarbonyl group, an aryloxycarbonyl group, a formylamino group, an acylamino group, an alkoxycarbonylamino group, an aryloxycarbonylamino group, a sulfonamido group, a ureido group, a sulfamoylamino group, an amino group, an alkylamino group, an arylamino group, an alkoxy group, an aryloxy group, a heteryloxy group, an alkylthio group, an arylthio group, a heterylthio group, a heterocyclic group, a halogen atom, a hydroxyl group, a nitro group, a sulfamoyl group, a sulfonyl group, an acyloxy group, a carbamoyloxy group, an imido group, a sulfinyl group, a phosphoryl group, a carboxyl group, or a phosphono group.

7. The silver halide color photographic light-sensitive material as claimed in claim 3, wherein $R^{11}$ and $R^{12}$ each represent an electron-attractive group whose Hammett substituent constant $\sigma_p$ value is 1.0 or below.

8. The silver halide color photographic light-sensitive material as claimed in claim 3, wherein $R^{11}$ and $R^{12}$ each represent an acyl group, a carbamoyl group, an alkoxycarbonyl group, an aryloxycarbonyl group, a cyano group, a nitro group, a sulfinyl group, a sulfonyl group, a sulfonyloxy group, a sulfamoyl group, an alkyl group substituted with at least three fluorine atoms, or a perfluoroaryl group.

9. The silver halide color photographic light-sensitive material as claimed in claim 3, wherein $R^{13}$ represents a hydrogen atom, an aryl group, an alkyl group, a cyano group, a formyl group, an acyl group, a carbamoyl group, an alkoxycarbonyl group, an aryloxycarbonyl group, a formylamino group, an acylamino group, an alkoxycarbonylamino group, an aryloxycarbonylamino group, a sulfonamido group, a ureido group, a sulfamoylamino group, an amino group, an alkylamino group, an arylamino group, an alkoxy group, an aryloxy group, a heteryloxy group, an alkylthio group, an arylthio group, a heterylthio group, a heterocyclic group, a halogen atom, a hydroxyl group, a nitro group, a sulfamoyl group, a sulfonyl group, an acyloxy group, a carbamoyloxy group, an imido group, a sulfinyl group, a phosphoryl group, a carboxyl group, or a phosphono group.

10. The silver halide color photographic light-sensitive material as claimed in claim 3, wherein $X^1$ and $X^2$ each represent a hydrogen atom, a halogen atom, an alkoxy group, an aryloxy group, an acyloxy group, a heterocyclic acyloxy group, a sulfonyloxy group, an acylamino group, a sulfonamido group, an alkoxycarbonyloxy group, an arylcarbonyloxy group, an aryloxycarbonyloxy group, an alkylthio group, an arylthio group, a heterocyclic thio group, a carbamoyloxy group, a carbamoylamino group, a heterocyclic oxy group, a 5- or 6-membered nitrogen-containing heterocyclic group, an imido group, an aromatic azo group, a sulfinyl group, or a sulfonyl group.

11. The silver halide color photographic light-sensitive material as claimed in claim 1, wherein the amount of the compound represented by formula (I) to be used is 0.0002 to 20 g per $m^2$ of the light-sensitive material.

12. The silver halide color photographic light-sensitive material as claimed in claim 1, further containing an antifading agent.

13. The silver halide color photographic light-sensitive material as claimed in claim 1, wherein $R^1$ and $R^2$ are each a cycloalkyl group.

14. The silver halide color photographic light-sensitive material as claimed in claim 1, wherein $R^1$ and $R^2$ are each a branched-chain alkyl group.

15. The silver halide color photographic light-sensitive material as claimed in claim 1, wherein $R^1$ or $R^2$ is a straight chain, branched-chain or cyclic aliphatic group.

16. The silver halide color photographic light-sensitive material as claimed in claim 1, wherein the aliphatic group is saturated or unsaturated and substituted or unsubstituted.

17. The silver halide color photographic light-sensitive material as claimed in claim 1, wherein R or R' represents a substituted or unsubstituted aromatic group.

18. The silver halide color photographic light-sensitive material as claimed in claim 1, wherein $R^1$ or $R^2$ represents a heterocyclic group that is a saturated or unsaturated 5 to 8 membered ring having 1 to 36 carbon atoms.

19. The silver halide color photographic light-sensitive material as claimed in claim 3, wherein the azole ring formed by $Z^1$ or $Z^2$ is selected from the group consisting of (Z-1)

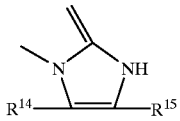

-continued (Z-2)

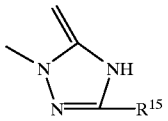

(Z-3)

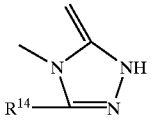

(Z-4)

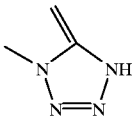

(Z-5)

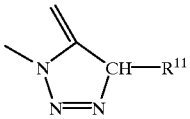

(Z-7)

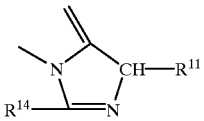

(Z-8)

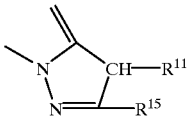

wherein $R^{14}$ and $R^{15}$ each represent a hydrogen atom or a substituent.

20. A silver halide color photographic light-sensitive material, comprising a non-color forming compound represented by formula (I) contained in at least one hydrophilic colloid layer on a support:

formula (I)

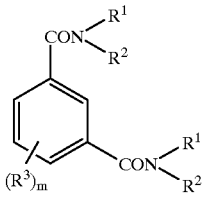

wherein $R^1$ or $R^2$ each represent an aliphatic group, an aromatic group, a cycloalkyl group, a cycloalkenyl group, or a heterocyclic group; $R^3$ represents an aryl group, an alkyl group, a hydroxyl group, a halogen atom, a carbamoyl group, an alkoxycarbonyl group, an acylamino group, a sulfonamido group, a ureido group, an alkylamino group, an alkoxy group, an aryloxy group, an alkylthio group, an arylthio group, a nitro group, a cyano group, a sulfonyl group, a carboxyl group, or a phosphono group; m is an integral number of 0 to 4; and $R^1$ and $R^2$ may bond together to form a ring.

* * * * *